US009890952B2

(12) United States Patent
Nagano et al.

(10) Patent No.: US 9,890,952 B2
(45) Date of Patent: Feb. 13, 2018

(54) EXHAUST STRUCTURE FOR COMBUSTION APPARATUS AND CONSTRUCTION METHOD THEREOF

(71) Applicant: NORITZ CORPORATION, Hyogo (JP)

(72) Inventors: Takanori Nagano, Kakogawa (JP); Armando Morales, Yorba Linda, CA (US)

(73) Assignee: NORITZ CORPORATION, Hyogo (JP)

( * ) Notice: Subject to any disclaimer, the term of this patent is extended or adjusted under 35 U.S.C. 154(b) by 122 days.

(21) Appl. No.: 14/678,429

(22) Filed: Apr. 3, 2015

(65) Prior Publication Data

US 2015/0308323 A1 Oct. 29, 2015

Related U.S. Application Data

(60) Provisional application No. 61/984,091, filed on Apr. 25, 2014, provisional application No. 62/029,943, filed on Jul. 28, 2014.

(51) Int. Cl.
*F01N 3/00* (2006.01)
*F01N 3/02* (2006.01)
(Continued)

(52) U.S. Cl.
CPC ..... *F23J 11/00* (2013.01); *F23J 13/02* (2013.01); *F23J 2213/101* (2013.01);
(Continued)

(58) Field of Classification Search
CPC ..... F23J 11/00; F23J 23/02; F23J 2213/101; F23J 2213/301; F23J 2213/50;
(Continued)

(56) References Cited

U.S. PATENT DOCUMENTS 5,718,045 A * 2/1998 Tsukahara ..... F01N 1/084 181/228
6,026,930 A * 2/2000 Ogisu ..... F01N 1/084 181/227
(Continued)

FOREIGN PATENT DOCUMENTS

JP H02-47343 Y2 12/1990
JP 2000-018566 A 1/2000
(Continued)

*Primary Examiner* — Mark Laurenzi
*Assistant Examiner* — Dapinder Singh
(74) *Attorney, Agent, or Firm* — Studebaker & Brackett PC

(57) ABSTRACT

An exhaust tube includes one end portion and the other end portion and is connected at one end portion to a combustion apparatus, of which inside is defined as an exhaust passage for combustion gas. An exhaust pipe has an outer diameter greater than that of exhaust tube, into which a part of exhaust tube on a side of the other end portion is introduced. An exhaust adapter is attached between an outer circumferential surface of exhaust tube and an inner circumferential surface of exhaust pipe. On the side close to the other end portion in exhaust tube relative to exhaust adapter, an exhaust passage hole 1*a* is provided separately from an opening in the other end portion of exhaust tube. Exhaust passage hole has an opening area greater than a cross-sectional area of the exhaust passage and is in communication with the exhaust passage.

11 Claims, 23 Drawing Sheets

(51) Int. Cl.
*F01N 3/10* (2006.01)
*F01N 3/20* (2006.01)
*F23J 11/00* (2006.01)
*F23J 13/02* (2006.01)

(52) U.S. Cl.
CPC ..... *F23J 2213/301* (2013.01); *F23J 2213/50* (2013.01); *F23J 2900/13005* (2013.01)

(58) Field of Classification Search
CPC ... F23J 2900/13005; F01N 13/18; F01N 1/02; F01N 1/084; F01N 13/08
USPC ..... 60/317, 323, 324
See application file for complete search history.

(56) References Cited

U.S. PATENT DOCUMENTS 6,710,506 B2 * 3/2004 Ishizuka ..... H02K 1/243 310/263
2003/0094208 A1 * 5/2003 Gabriel ..... F01N 13/08 138/120
2011/0047998 A1 * 3/2011 Adachi ..... F01N 13/008 60/324
2011/0048847 A1 * 3/2011 Helgeson ..... F01D 25/285 181/220
2012/0168245 A1 * 7/2012 Wakatsuki ..... F01N 1/02 181/228
2012/0180465 A1 * 7/2012 Takagaki ..... F01N 1/02 60/324
2012/0273302 A1 * 11/2012 Takagaki ..... F01N 1/02 181/228
2013/0130606 A1 * 5/2013 Brunette ..... F23J 13/02 454/47
2013/0189915 A1 * 7/2013 Hazard ..... F23J 13/02 454/47
2015/0267637 A1 * 9/2015 Kuroyanagi ..... F28F 9/02 165/52

FOREIGN PATENT DOCUMENTS

JP 2003-343790 A 12/2003
JP 2008-082613 A 4/2008

* cited by examiner

EXHAUST STRUCTURE FOR COMBUSTION APPARATUS AND CONSTRUCTION METHOD THEREOF

BACKGROUND OF THE INVENTION

Field of the Invention

The present invention relates to an exhaust structure for combustion apparatus and a construction method thereof.

Description of the Background Art

In markets, there are locations where an exhaust pipe (a B vent) already placed in a building cannot be removed from a point of view of maintaining appearance of buildings. At such a location, a combustion apparatus can be replaced by introducing a new exhaust tube (a flexible exhaust tube) into the exhaust pipe and an exhaust terminal (a rain cap) which have already been placed.

The technique related to an exhaust pipe of the combustion apparatus is disclosed, for example, in Japanese Patent Laying-Open No. 2000-18566, Japanese Patent Laying-Open No. 2008-82613, and the like. Also, a method for inserting an exhaust tube into an already-placed exhaust pipe is disclosed, for example, in Japanese Utility Model Publication No. 02-47343, Japanese Patent Laying-Open No. 2003-343790 and the like.

When a new exhaust tube is inserted into the already-placed exhaust pipe and exhaust terminal from inside the building, the end of the exhaust tube may come into contact with a ceiling wall of the already-placed exhaust terminal. In this case, the exhaust port of combustion gas in the exhaust tube is blocked by the ceiling wall of the exhaust terminal, which leads to a problem that combustion gas cannot be sufficiently emitted from the exhaust tube.

SUMMARY OF THE INVENTION

The present invention has been made in light of the above-described problems. An object of the present invention is to provide an exhaust structure for combustion apparatus capable of stably emitting combustion gas to the outside of the building without changing the external appearance of the building, and a construction method thereof.

An exhaust structure for combustion apparatus according to the present invention includes a combustion apparatus, an exhaust tube, an exhaust pipe, and an exhaust adapter. The exhaust tube includes one end portion and the other end portion and is connected at the one end portion to the combustion apparatus, of which inside is defined as an exhaust passage for combustion gas. The exhaust pipe has an outer diameter greater than that of the exhaust tube, and a part of the exhaust tube on a side of the other end portion is introduced into the exhaust pipe. The exhaust adapter is attached between an outer circumferential surface of the exhaust tube and an inner circumferential surface of the exhaust pipe. On a side close to the other end portion in the exhaust tube relative to the exhaust adapter, an exhaust passage hole is provided separately from an opening in the other end portion of the exhaust tube, has an opening area greater than a cross-sectional area of the exhaust passage, and is in communication with the exhaust passage.

According to the exhaust structure for combustion apparatus of the present invention, the exhaust passage hole is provided on the side close to the other end portion in the exhaust tube relative to the exhaust adapter and separately from the opening in the other end portion of the exhaust tube. Accordingly, even if the other end portion of the exhaust tube is blocked by a ceiling wall of the exhaust terminal, combustion gas can still be emitted to the outside of the building through the exhaust passage hole.

Furthermore, the exhaust passage hole has an opening area greater than the cross-sectional area of the exhaust passage inside the exhaust tube. Accordingly, exhaust resistance is not caused by the exhaust passage hole, so that combustion gas can be stably emitted to the outside of the building through the exhaust passage hole.

In the above-described exhaust structure for combustion apparatus, the exhaust passage hole is a through hole portion provided in the exhaust tube.

According to such a simple configuration in which a through hole is provided in the exhaust tube in this way, combustion gas can be stably emitted to the outside of the building.

In the above-described exhaust structure for combustion apparatus, the through hole portion includes a plurality of through holes provided in the exhaust tube so as to be spaced apart from each other.

By providing the through hole portion consisting of a plurality of separate through holes in this way, the strength of the exhaust tube required for introduction into the exhaust pipe can be readily ensured. Furthermore, by providing the through hole portion consisting of a plurality of separate through holes, emission of combustion gas from the exhaust tube can be readily controlled.

In the above-described exhaust structure for combustion apparatus, a space formation member attached to the other end portion of the exhaust tube is further provided. The exhaust passage hole is provided in the space formation member.

In this way, the space formation member is provided separately from the exhaust tube and the exhaust passage hole is provided in this space formation member, thereby improving the flexibility of each of the shape and the arrangement position of the exhaust passage hole. Therefore, it becomes possible to achieve a structure that is more suitable for emission of combustion gas.

In the above-described exhaust structure for combustion apparatus, the space formation member includes an exhaust tube support portion supported by the exhaust tube, and a frame portion formed in a shape of an arch-shaped plate and supported by the exhaust tube support portion. The exhaust passage hole is surrounded by the frame portion and the exhaust tube support portion.

By using such a frame portion formed in the shape of an arch-shaped plate, the top portion of the arch can be brought into contact with the ceiling wall of the exhaust terminal while combustion gas can be emitted through the exhaust passage hole surrounded by the frame portion and the exhaust tube support portion.

In the above-described exhaust structure for combustion apparatus, the space formation member has an exhaust tube support portion supported by the exhaust tube and a protruding portion protruding from the exhaust tube support portion to a side opposite to the exhaust tube. The exhaust passage hole is provided in the protruding portion.

By using such a protruding portion, the top portion of this protruding portion can be brought into contact with the ceiling wall of the exhaust terminal while combustion gas can be emitted through the exhaust passage hole.

In the above-described exhaust structure for combustion apparatus, the protruding portion includes a reduced diameter portion, a flange portion extending radially outward from the reduced diameter portion, and a curved portion curved in a convex shape toward a side opposite to the reduced diameter portion relative to the flange portion. The exhaust passage hole is provided in one or more selected from a group consisting of the reduced diameter portion, the flange portion and the curved portion.

Since the curved portion of the space formation member is curved in a convex shape in this way, the contact resistance caused between the curved portion and the inner circumferential surface of the exhaust pipe can be reduced when the other end portion of the exhaust tube having this space formation member attached thereto is inserted into the exhaust pipe. Consequently, the exhaust tube having the space formation member attached thereto can be smoothly inserted into the exhaust pipe.

In the above-described exhaust structure for combustion apparatus, the exhaust passage hole is provided at a position where the exhaust passage hole cannot be seen when the protruding portion is viewed from a side of the protruding portion toward a side of the exhaust tube support portion.

Accordingly, when the other end portion of the exhaust tube having this space formation member attached thereto is inserted into the exhaust pipe, foreign substances are less likely to come into the exhaust tube through the exhaust passage hole of the space formation member.

In the above-described exhaust structure for combustion apparatus, the protruding portion includes a cylindrical portion extending from the exhaust tube support portion and a tip end portion formed at a tip end of the cylindrical portion. The exhaust passage hole is provided in at least one of the cylindrical portion and the tip end portion.

The space formation member has the cylindrical portion and the tip end portion in this way. Accordingly, the other end portion of the exhaust tube having this space formation member attached thereto is inserted into the exhaust pipe, so that the exhaust tube can be inserted into the exhaust pipe in a highly straight manner.

In the above-described exhaust structure for combustion apparatus, the exhaust passage hole is a hole provided by opening a cut portion in the exhaust tube by compressing the exhaust tube, the cut portion being formed by cutting the exhaust tube from the outer circumferential surface to an inner circumferential surface.

This cut portion is a hole that is closed before the other end portion of the exhaust tube comes into contact with the ceiling wall of the exhaust terminal, and opened when the other end portion comes into contact with the ceiling wall to thereby exert compression force on the exhaust tube. Accordingly, when the exhaust tube is inserted into the exhaust pipe, the cut portion is closed, so that foreign substances can be prevented from coming into the exhaust tube through this cut portion. Furthermore, after insertion of the exhaust tube into the exhaust pipe is completed, the cut portion is opened by compression force, so that combustion gas can be emitted from the exhaust tube.

A construction method of an exhaust structure for combustion apparatus according to the present invention provides a method of constructing an exhaust structure for combustion apparatus, by which an exhaust tube is inserted into an exhaust pipe extending from inside to outside of a building. An exhaust terminal is provided at a tip end portion of the exhaust pipe on the outside. The construction method includes the following steps.

An exhaust passage hole is provided in the exhaust tube having one end portion and the other end portion so as to be located on a side of the other end portion separately from an opening in the other end portion of the exhaust tube. The exhaust passage hole has an opening area greater than a cross-sectional area of an exhaust passage and is in communication with an inner passage of the exhaust tube. The exhaust tube is inserted into the exhaust pipe until a part of the exhaust tube on the side of the other end portion provided with the exhaust passage hole comes into contact with a ceiling wall of the exhaust terminal. The one end portion of the exhaust tube is connected to the combustion apparatus.

According to the construction method of an exhaust structure for combustion apparatus of the present invention, the exhaust tube only has to be inserted into the exhaust pipe from the inside of the building, and connected to the combustion apparatus inside the building. Accordingly, a contractor does not have to climb on to the roof of the building to remove the exhaust terminal from the exhaust pipe, so that the working performance for construction is significantly improved.

Furthermore, the exhaust passage hole is provided, separately from the opening in the other end portion of the exhaust tube, on the side close to the other end portion in the exhaust tube relative to the exhaust adapter. Accordingly, even if the other end portion of the exhaust tube is blocked by the ceiling wall of the exhaust terminal, combustion gas can be emitted to the outside of the building through the exhaust passage hole.

Furthermore, the exhaust passage hole has an opening area greater than the cross-sectional area of the exhaust passage inside the exhaust tube. Accordingly, exhaust resistance is not caused by the exhaust passage hole, so that combustion gas can be stably emitted to the outside of the building through the exhaust passage hole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The embodiments of the present invention will be hereinafter described with reference to the accompanying drawings.

First Embodiment

An exhaust structure for combustion apparatus in the present embodiment will be first described with reference to FIGS. 1 to 3.

Figure 1:
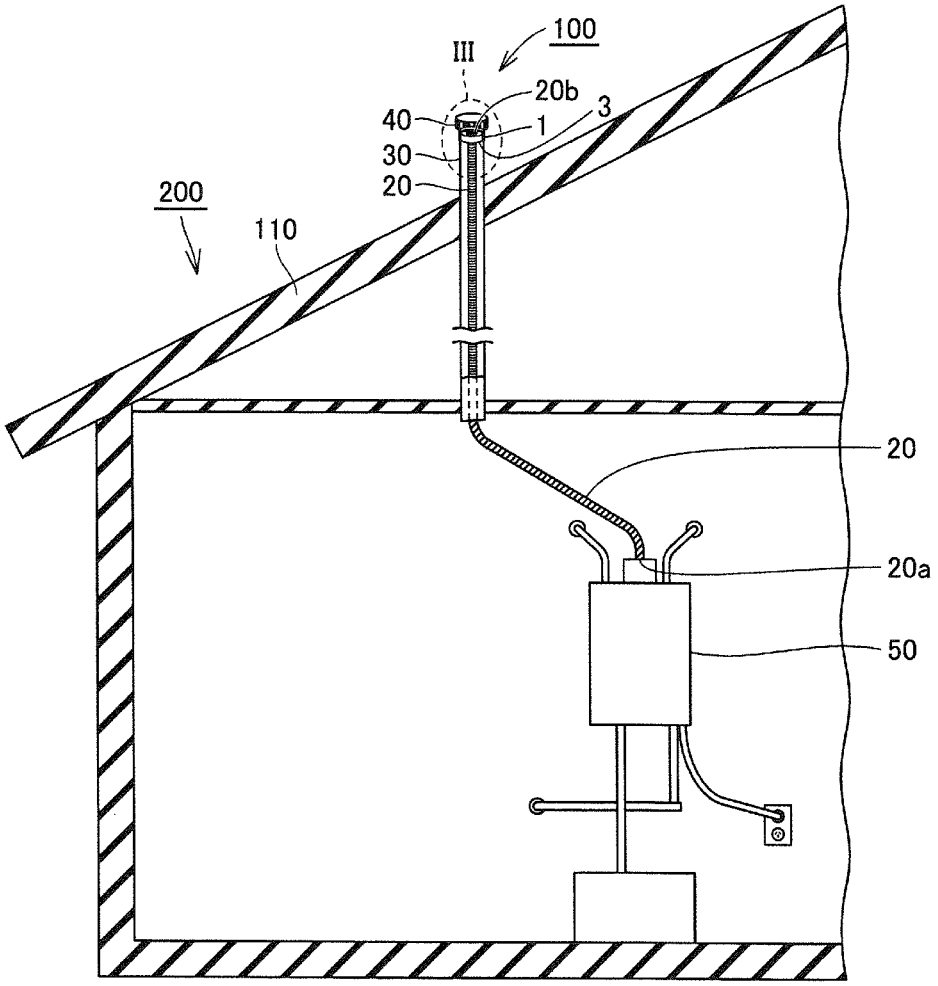
FIG. 1 is a diagram schematically showing the state where an exhaust structure for combustion apparatus in the first embodiment of the present invention is placed in a building.
Figure 2:
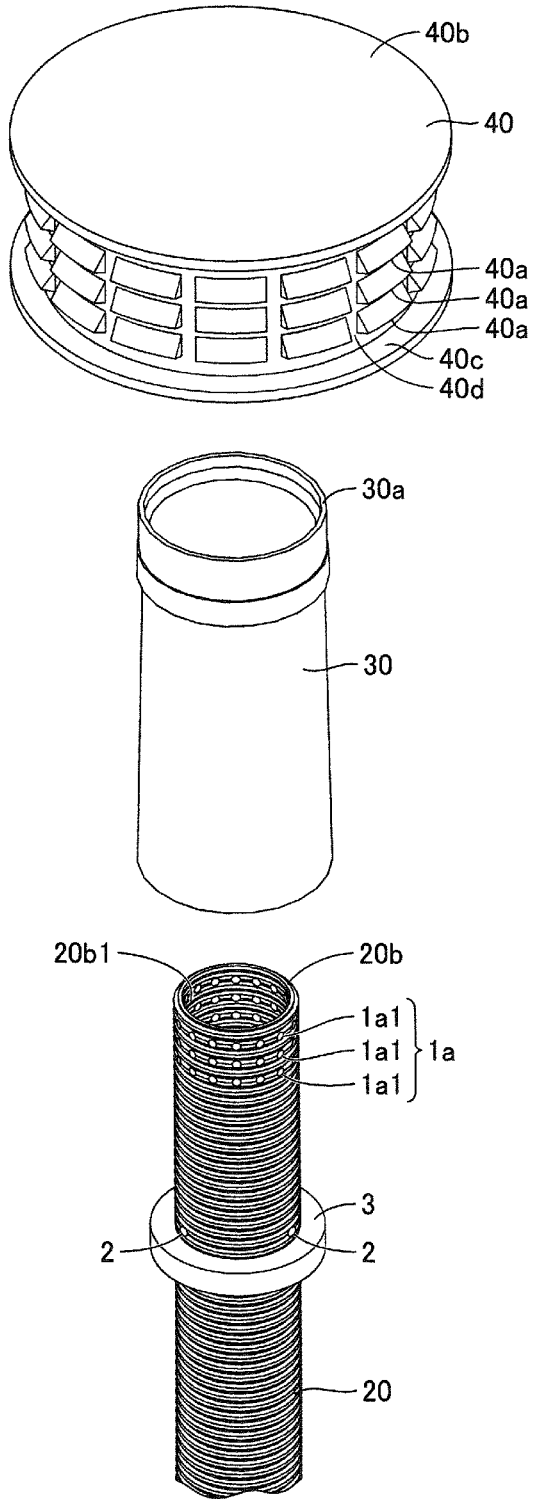
FIG. 2 is an exploded perspective view schematically showing the configuration of the exhaust structure for combustion apparatus in the first embodiment of the present invention.
Figure 3:
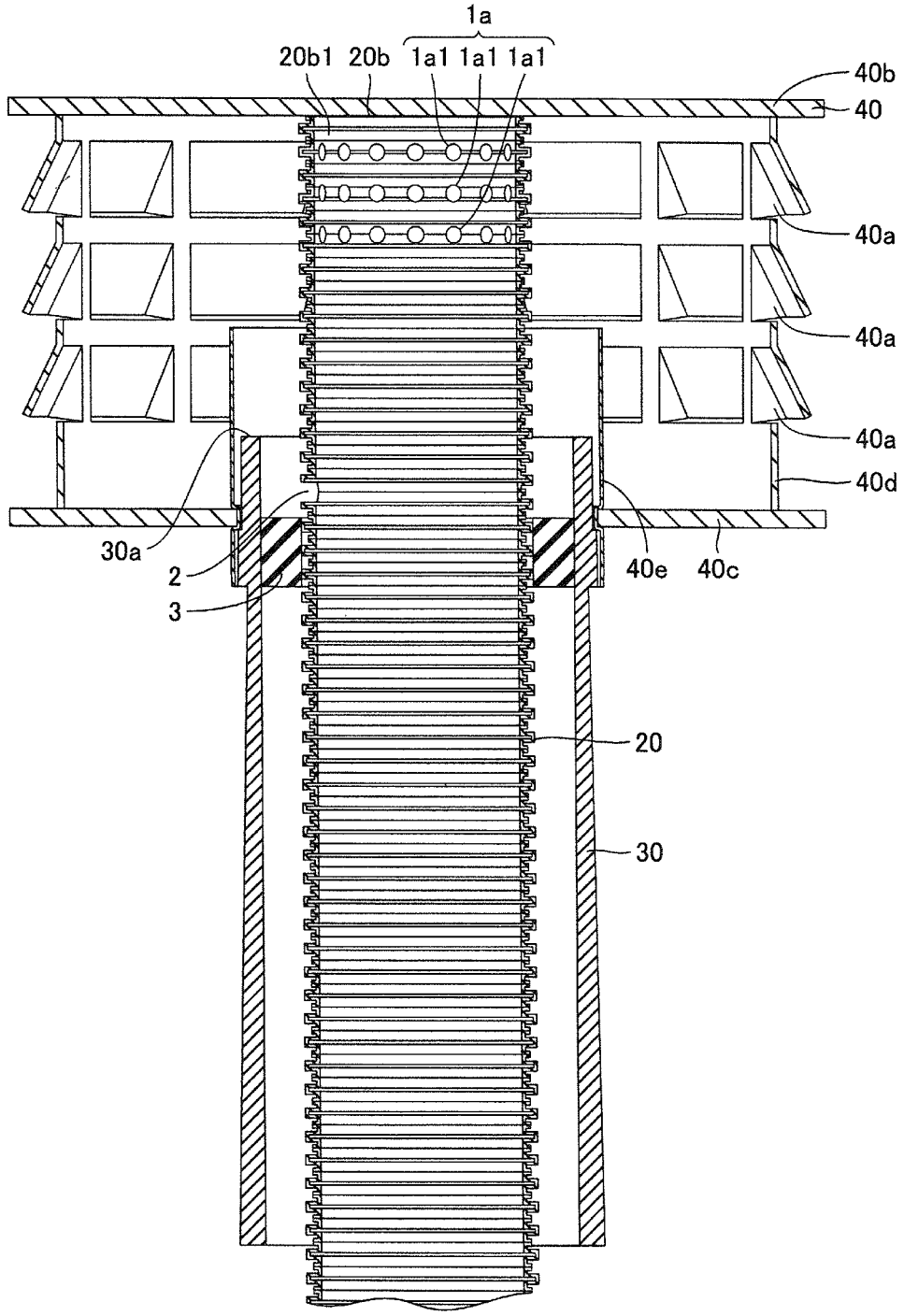
FIG. 3 is a cross-sectional view showing, in an enlarged manner, a region III in FIG. 1 schematically showing the configuration of the exhaust structure for combustion apparatus in the first embodiment of the present invention.

Referring to FIGS. 1 to 3, an exhaust structure for combustion apparatus 100 in the present embodiment mainly has an exhaust adapter 3, an exhaust tube 20, an exhaust pipe 30, an exhaust terminal 40, and a combustion apparatus 50. This exhaust structure for combustion apparatus 100 serves to emit combustion gas produced in combustion apparatus 50 to the outside of a building 200.

Combustion apparatus 50 is placed inside building 200. This combustion apparatus 50 serves as a water heater that heats water, for example, with combustion gas, and may be a heating apparatus or the like that warms up the inside of the building with combustion gas. Furthermore, in the case where a water heater is used as combustion apparatus 50, this water heater may be, for example, a water heater of a latent heat recovery type adapted to an exhaust suction and combustion system.

Exhaust tube 20 includes one end portion 20*a* and the other end portion 20*b*. One end portion 20*a* of exhaust tube 20 is connected to combustion apparatus 50 and the other end portion 20*b* of exhaust tube 20 extends to the outside of the building. The inside of exhaust tube 20 is defined as an exhaust path for the combustion gas exhausted from combustion apparatus 50. Thus, the combustion gas produced in combustion apparatus 50 can be guided to the outside through exhaust tube 20. Although exhaust tube 20 is implemented as a flexible pipe such as an accordion pipe, it may be a spiral pipe.

Exhaust pipe 30 is attached to building 200 so as to extend from the inside to the outside, for example, through a roof 110 of building 200. Exhaust pipe 30 may extend from the inside to the outside through a wall. Exhaust pipe 30 has an outer diameter greater than that of exhaust tube 20. Into this exhaust pipe 30, a part of exhaust tube 20 on the other end portion 20*b* side is introduced.

Exhaust terminal 40 is attached to a tip end of exhaust pipe 30 on the outside of the building. This exhaust terminal 40 has a ceiling wall 40*b*, a bottom wall 40*c*, a circumferential wall 40*d*, and a connection pipe portion 40*e* (FIG. 3). Ceiling wall 40*b* is attached to an upper end of circumferential wall 40*d*, and bottom wall 40*c* is attached to a lower end of circumferential wall 40*d*. Connection pipe portion 40*e* is formed in a cylindrical shape and attached to bottom wall 40*c* so as to penetrate bottom wall 40*c*. In circumferential wall 40*d*, an exhaust port 40*a* for exhausting the combustion gas to the outside (to the outside of the building) is formed. This exhaust port 40*a* allows the combustion gas guided through exhaust tube 20 to be exhausted from exhaust terminal 40 to the outside of building 200 through exhaust pipe 30.

Connection pipe portion 40*e* of exhaust terminal 40 is connected to exhaust pipe 30. This connection pipe portion 40*e* may be an outer cover attached on an outer circumferential side of exhaust pipe 30 or an inner cover attached on an inner circumferential side of exhaust pipe 30. Exhaust terminal 40 is made, for example, of such a material as aluminum or stainless steel.

Exhaust adapter 3 serves to fix exhaust tube 20 to exhaust pipe 30. This exhaust adapter 3 is fitted to an outer circumferential surface of exhaust tube 20 and fitted to an inner circumferential surface of exhaust pipe 30. Exhaust adapter 3 has an inner circumferential surface pressing the outer circumferential surface of exhaust tube 20 while it is fitted to the outer circumferential surface of exhaust tube 20, and has an outer circumferential surface pressing the inner circumferential surface of exhaust pipe 30 while it is fitted to the inner circumferential surface of exhaust pipe 30.

Thus, the inner circumferential surface of exhaust adapter 3 is in intimate contact with the outer circumferential surface of exhaust tube 20 while the outer circumferential surface of exhaust adapter 3 is in intimate contact with the inner circumferential surface of exhaust pipe 30. Therefore, exhaust tube 20 can firmly be fixed to exhaust pipe 30 with exhaust adapter 3, and exhaust adapter 3 can prevent leakage of the combustion gas or drainage water from between exhaust tube 20 and exhaust pipe 30 and hence backflow thereof into the inside of building.

Exhaust tube 20 has an exhaust passage hole 1*a* on the side close to the other end portion 20*b* relative to the position at which exhaust adapter 3 is attached to exhaust tube 20. This exhaust passage hole 1*a* is provided separately from an opening 20*b*1 provided in the other end portion 20*b* of exhaust tube 20, has an opening area greater than the cross-sectional area of the exhaust passage inside exhaust tube 20, and is in communication with the exhaust passage. In this case, the cross-sectional area of the exhaust passage of exhaust tube 20 means an area of the internal space of exhaust tube 20 in the state where exhaust tube 20 is vertically cut in the direction in which exhaust tube 20 extends.

Exhaust passage hole 1*a* is, for example, a through hole portion 1*a* formed in the outer circumferential surface of exhaust tube 20. This through hole portion 1*a* includes a plurality of through holes 1*a*1 that are provided at a distance from each other in the outer circumferential surface of exhaust tube 20. A plurality of (for example, eight) through holes 1*a*1 are arranged along the circumferential direction of exhaust tube 20 while a plurality of (for example, three) through holes 1*a*1 are arranged along the direction in which exhaust tube 20 extends. The plurality of through holes 1*a*1 may be arranged at regular intervals (every 45°) along the circumferential direction of exhaust tube 20 or may be arranged at regular intervals along the direction in which exhaust tube 20 extends. The total sum of the opening areas of the plurality of through holes 1*a*1 is greater than the cross-sectional area of the exhaust passage inside exhaust tube 20.

It is to be noted that the number of through holes 1*a*1 arranged in the circumferential direction and in the direction in which exhaust tube 20 extend is not limited to the above. Although each of the plurality of through holes 1*a*1 is implemented as a through hole in a shape, for example, of a circle (a perfect circle, an oval shape, or an elliptical shape), the shape is not limited as such and the through hole may be implemented as a through hole in a polygonal shape such as a triangular shape and a rectangular shape, or a through hole in any shape.

Exhaust tube 20 is provided with a drainage water recovering hole 2 at the height level between exhaust adapter 3 and an upper end 30*a* of exhaust pipe 30. The drainage water accumulated in a space above exhaust adapter 3 and between the outer circumferential surface of exhaust tube 20 and the inner circumferential surface of exhaust pipe 30 can be recovered in exhaust tube 20 through this drainage water recovering hole 2. The number of drainage water recovering holes 2 provided in exhaust tube 20 may be more than one. For example, three drainage water recovering holes 2 may be arranged at regular intervals (every 120°) in the circumferential direction of exhaust tube 20.

Combustion apparatus 50 used in exhaust structure for combustion apparatus 100 set forth above may be a water heater of a latent heat recovery type, for example, adapted to an exhaust suction and combustion system, as described above. The configuration of water heater 50 of the latent heat recovery type adapted to the exhaust suction and combustion system will be described below with reference to FIGS. 4 and 5.

Figure 4:
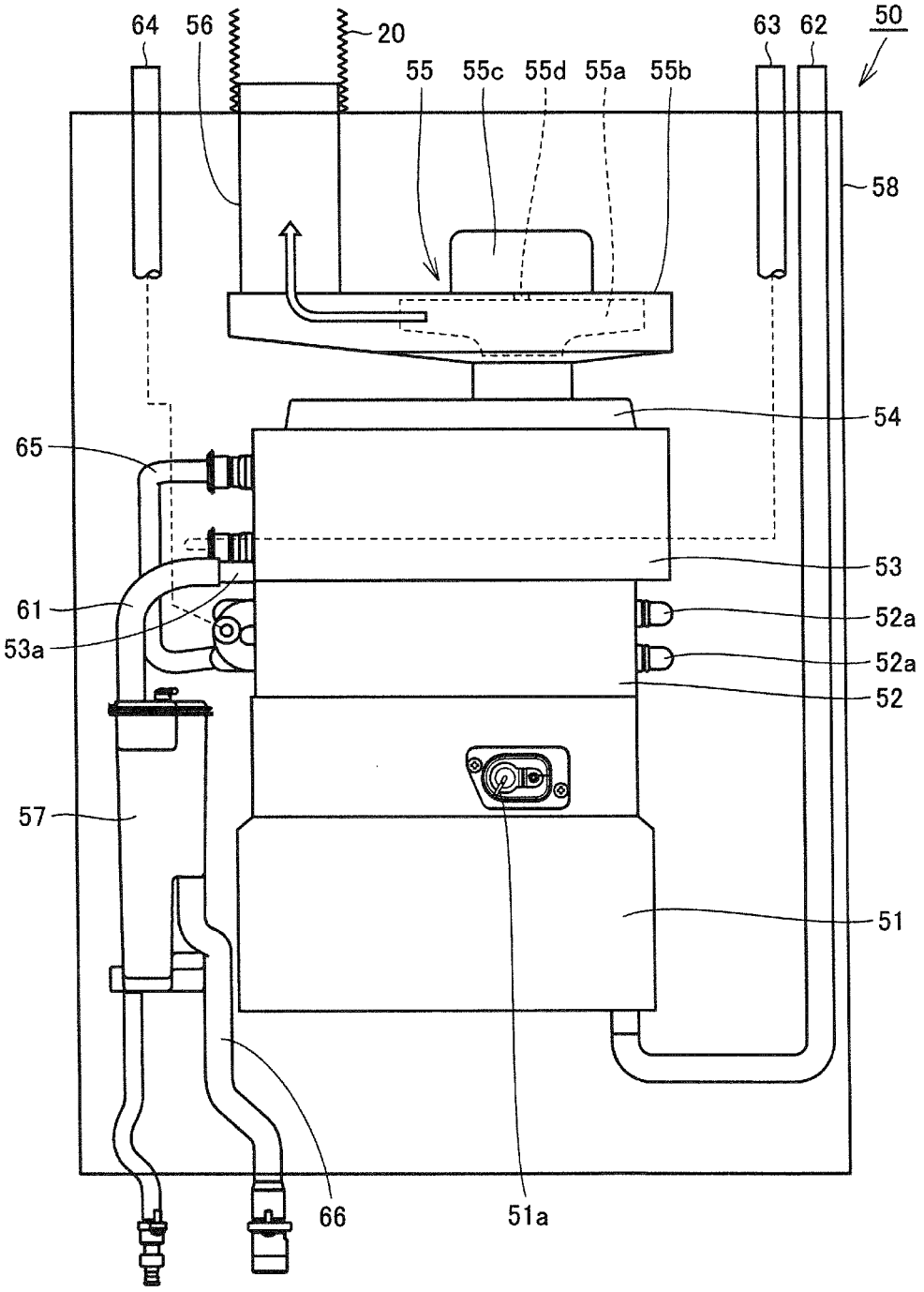
FIG. 4 is a front view schematically showing a configuration of a water heater included as an example of a combustion apparatus in the exhaust structure for combustion apparatus in the first embodiment of the present invention.
Figure 5:
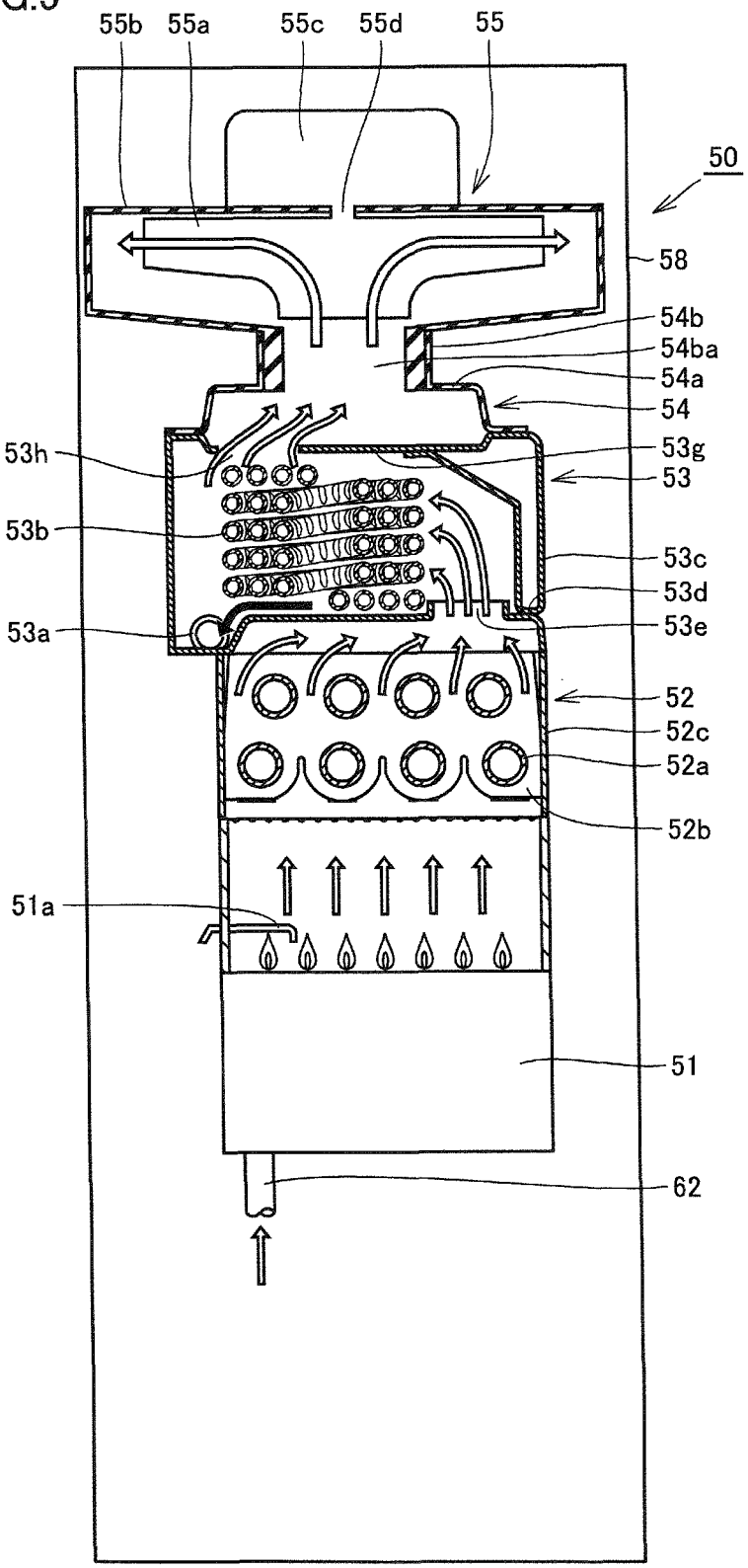
FIG. 5 is a partial cross-sectional side view schematically showing the configuration of the water heater shown in FIG. 4.

Referring to FIGS. 4 and 5, water heater 50 mainly has a burner 51, a primary heat exchanger 52, a secondary heat exchanger 53, an exhaust box 54, a fan 55, a connection pipe 56, a drainage water tank 57, a housing 58, and pipes 61 to 66.

Burner 51 serves to produce a combustion gas by burning a fuel gas. A gas supply pipe 62 is connected to burner 51. This gas supply pipe 62 serves to supply a fuel gas to burner 51. A gas valve (not shown) implemented, for example, by an electromagnetic valve is attached to this gas supply pipe 62.

A spark plug 51*a* is arranged above burner 51. This spark plug 51*a* serves to ignite an air fuel mixture injected from burner 51 to thereby produce a flame, by generating sparks between the plug and a target (not shown) provided in burner 51 by activating an ignition device (an igniter). Burner 51 generates a quantity of heat by burning a fuel gas supplied from gas supply pipe 62 (which is called a combustion operation).

Primary heat exchanger 52 is a heat exchanger of a sensible heat recovery type. This primary heat exchanger 52 mainly has a plurality of plate-shaped fins 52*b*, a heat conduction pipe 52*a* penetrating the plurality of plate-shaped fins 52*b*, and a case 52*c* accommodating fins 52*b* and heat conduction pipe 52*a*. Primary heat exchanger 52 exchanges heat with the combustion gas generated by burner 51, and specifically, it serves to heat water which flows through heat conduction pipe 52*a* of primary heat exchanger 52 with the quantity of heat generated as a result of the combustion operation of burner 51.

Secondary heat exchanger 53 is a heat exchanger of a latent heat recovery type. This secondary heat exchanger 53 is located downstream of primary heat exchanger 52 in a flow of the combustion gas and connected in series with primary heat exchanger 52. Since water heater 50 according to the present embodiment thus has secondary heat exchanger 53 of a latent heat recovery type, it is water heater 50 of the latent heat recovery type.

Secondary heat exchanger 53 mainly has a drainage water discharge port 53*a*, a heat conduction pipe 53*b*, a sidewall 53*c*, a bottom wall 53*d*, and an upper wall 53*g*. Heat conduction pipe 53*b* is layered as it is spirally wound. Sidewall 53*c*, bottom wall 53*d*, and upper wall 53*g* are arranged to surround heat conduction pipe 53*b*.

In secondary heat exchanger 53, water which flows through heat conduction pipe 53*b* is pre-heated (heated) through heat exchange with the combustion gas of which heat has been exchanged in primary heat exchanger 52. As a temperature of the combustion gas is lowered to approximately 60° C. through this process, moisture contained in the combustion gas is condensed so that latent heat can be obtained. In addition, latent heat is recovered in secondary heat exchanger 53 and moisture contained in the combustion gas is condensed, whereby drainage water is produced.

Bottom wall 53*d* serves as a partition between primary heat exchanger 52 and secondary heat exchanger 53, and it also serves as an upper wall of primary heat exchanger 52. This bottom wall 53*d* is provided with an opening portion 53*e*, and this opening portion 53*e* allows communication between a space where heat conduction pipe 52*a* of primary heat exchanger 52 is arranged and a space where heat conduction pipe 53*b* of secondary heat exchanger 53 is arranged. As shown with hollow arrows in FIG. 5, the combustion gas can flow from primary heat exchanger 52 to secondary heat exchanger 53 through opening portion 53*e*. In this embodiment, although one common component is employed for bottom wall 53*d* of secondary heat exchanger 53 and the upper wall of primary heat exchanger 52 for the sake of simplification, an exhaust collection and guide member may be connected between primary heat exchanger 52 and secondary heat exchanger 53.

Upper wall 53*g* is provided with an opening portion 53*h*, and this opening portion 53*h* allows communication between the space where heat conduction pipe 53*b* of secondary heat exchanger 53 is arranged and an internal space in exhaust box 54. As shown with hollow arrows in FIG. 5, the combustion gas can flow from secondary heat exchanger 53 into the internal space in exhaust box 54 through opening portion 53*h*.

Drainage water discharge port 53*a* is provided in sidewall 53*c* or bottom wall 53*d*. This drainage water discharge port 53*a* opens at the lowest position in the space surrounded by side wall 53*c*, bottom wall 53*d* and upper wall 53*g* (at the lowermost position in the vertical direction in the state of placement of the water heater), which is lower than the lowermost portion of heat conduction pipe 53*b*. Thus, drainage water produced in secondary heat exchanger 53 can be guided to drainage water discharge port 53*a* along bottom wall 53*d* and sidewall 53*c* as shown with a black arrow in FIG. 5.

Exhaust box 54 forms a path for a flow of the combustion gas between secondary heat exchanger 53 and fan 55. This exhaust box 54 can guide the combustion gas of which heat has been exchanged in secondary heat exchanger 53 to fan 55. Exhaust box 54 is attached to secondary heat exchanger 53 and located downstream of secondary heat exchanger 53 in the flow of the combustion gas.

Exhaust box 54 mainly has a box main body 54*a* and a fan connection portion 54*b*. An internal space in box main body 54*a* communicates through opening portion 53*h* in secondary heat exchanger 53 with the internal space where heat conduction pipe 53*b* of secondary heat exchanger 53 is arranged. Fan connection portion 54*b* is provided so as to protrude from an upper portion of box main body 54*a*. This fan connection portion 54*b* has, for example, a cylindrical shape, and an internal space 54*ba* thereof communicates with the internal space in box main body 54*a*.

Fan 55 serves to emit the combustion gas (of which heat has been exchanged in secondary heat exchanger 53) which has passed through secondary heat exchanger 53 to the outside of water heater 50 by suctioning the combustion gas. This fan 55 is located downstream of exhaust box 54 and secondary heat exchanger 53 in the flow of the combustion gas. Namely, in water heater 50, burner 51, primary heat exchanger 52, secondary heat exchanger 53, exhaust box 54, and fan 55 are arranged in this order from upstream to downstream in the flow of the combustion gas produced in burner 51. Since the combustion gas is suctioned and exhausted by means of fan 55 as above in this arrangement, water heater 50 in the present embodiment is a water heater adapted to an exhaust suction and combustion system.

Fan 55 mainly has an impeller 55*a*, a fan case 55*b*, a drive source 55*c*, and a rotation shaft 55*d*. Fan case 55*b* is attached to fan connection portion 54*b* of exhaust box 54 such that an internal space in fan case 55*b* and the internal space in fan connection portion 54*b* communicate with each other. Thus, as shown with hollow arrows in FIG. 5, the combustion gas can be suctioned from box main body 54*a* of exhaust box 54 through fan connection portion 54*b* into fan case 55*b*.

Impeller 55*a* is arranged in fan case 55*b*. This impeller 55*a* is connected to drive source 55*c* with rotation shaft 55*d* interposed therebetween. Thus, impeller 55*a* is provided with drive force from drive source 55*c* and can rotate around rotation shaft 55*d*. With rotation of impeller 55*a*, the combustion gas in exhaust box 54 can be suctioned from the inner circumferential side of impeller 55*a* and can be emitted toward the outer circumferential side of impeller 55*a*.

Connection pipe 56 is connected to a region within fan case 55*b*, on the outer circumferential side of a region where impeller 55*a* is arranged. Therefore, the combustion gas emitted to the outer circumferential side of impeller 55*a* by impeller 55*a* of fan 55 can be emitted into exhaust tube 20 through connection pipe 56.

The combustion gas produced by burner 51 as above is suctioned by fan 55 with rotation of impeller 55*a* above, so that the combustion gas can reach fan 55 after passage through primary heat exchanger 52, secondary heat exchanger 53, and exhaust box 54 in this order as shown with the hollow arrows in the figure and can be exhausted to the outside of water heater 50.

Drainage water tank 57 serves to store drainage water produced in secondary heat exchanger 53. This drainage water tank 57 is connected to secondary heat exchanger 53 through pipe 61. Pipe 61 is connected to drainage water discharge port 53*a* of secondary heat exchanger 53. Thus, the drainage water produced in secondary heat exchanger 53 can be discharged to drainage water tank 57. Pipe 66 extending to the outside of water heater 50 is connected to drainage water tank 57. The drainage water stored in drainage water tank 57 can be discharged to the outside of water heater 50 through this pipe 66.

This drainage water tank 57 has a water seal structure. Namely, drainage water tank 57 has such a structure that, as a prescribed amount of drainage water is stored in drainage water tank 57, the stored drainage water cannot allow air to pass through drainage water tank 57. With such a water seal structure of drainage water tank 57, entry of air outside water heater 50 (outside air) into water heater 50 (secondary heat exchanger 53) through drainage water tank 57 via pipe 66 can be prevented.

Water supply pipe 63 is connected to one end of heat conduction pipe 53*b* of secondary heat exchanger 53 and hot water delivery pipe 64 is connected to one end of heat conduction pipe 52*a* of primary heat exchanger 52. The other end of heat conduction pipe 52*a* of primary heat exchanger 52 and the other end of heat conduction pipe 53*b* of secondary heat exchanger 53 are connected to each other through connection pipe 65. Each of gas supply pipe 62, water supply pipe 63, and hot water delivery pipe 64 mentioned above leads to the outside, for example, in a top portion of water heater 50. Burner 51, primary heat exchanger 52, secondary heat exchanger 53, exhaust box 54, fan 55, drainage water tank 57, and the like are arranged in housing 58.

Then, the method of constructing the exhaust structure for combustion apparatus according to the present embodiment will be hereinafter described with reference to FIGS. 6, 7 and 3.

Figure 6:
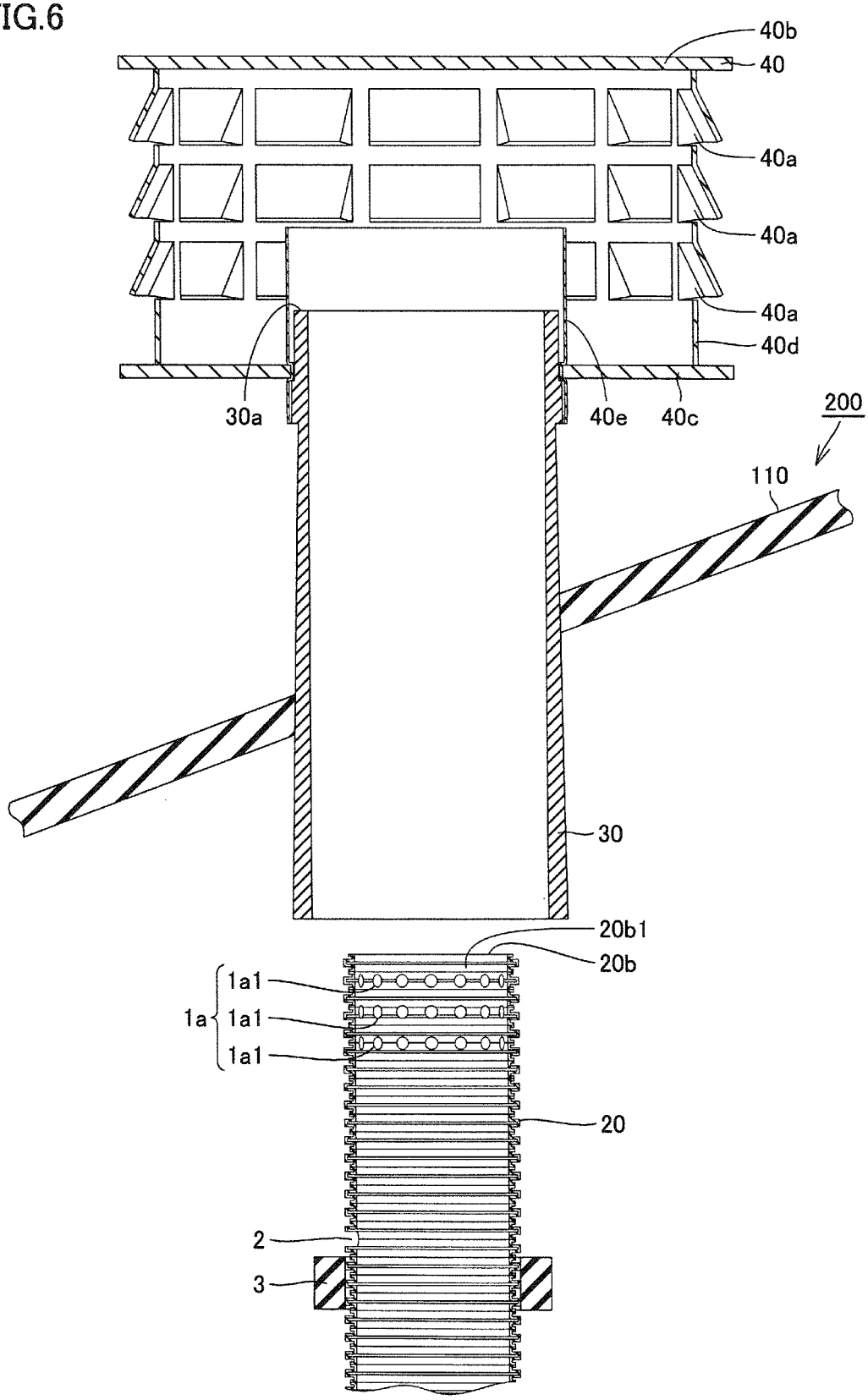
FIG. 6 is a cross-sectional view schematically showing the first step of the construction method of the exhaust structure for combustion apparatus in the first embodiment of the present invention.

Referring to FIG. 6, exhaust pipe 30 is placed in a roof 110 of building 200 so as to extend from the inside of building 200 to the outside thereof. Exhaust terminal 40 is attached to a tip end portion (near an upper end 30*a*) of this exhaust pipe 30 on the outside of the building. In this state, a preparation for inserting exhaust tube 20 into exhaust pipe 30 is made. In preparation for this, through hole portion 1*a*, for example, consisting of a plurality of through holes 1*a*1 is provided as an exhaust passage hole on the other end portion 20*b* side of exhaust tube 20. As described above, through hole portion 1*a* is provided separately from opening 20*b*1 in the other end portion 20*b* of exhaust tube 20, and formed so as to have an opening area greater than the cross-sectional area of the exhaust passage inside exhaust tube 20 and so as to be in communication with the internal passage of exhaust tube 20. Furthermore, drainage water recovering hole 2 is provided on the side close to one end portion 20*a* of exhaust tube 20 relative to the plurality of through holes 1*a*1.

Furthermore, on the side close to one end portion 20*a* in exhaust tube 20 relative to drainage water recovering hole 2, exhaust adapter 3 is fitted on the outer circumferential surface of exhaust tube 20. Exhaust adapter 3 is fitted on the outer circumferential surface of exhaust tube 20 such that the inner circumferential surface of exhaust adapter 3 presses the outer circumferential surface of exhaust tube 20.

Figure 7:
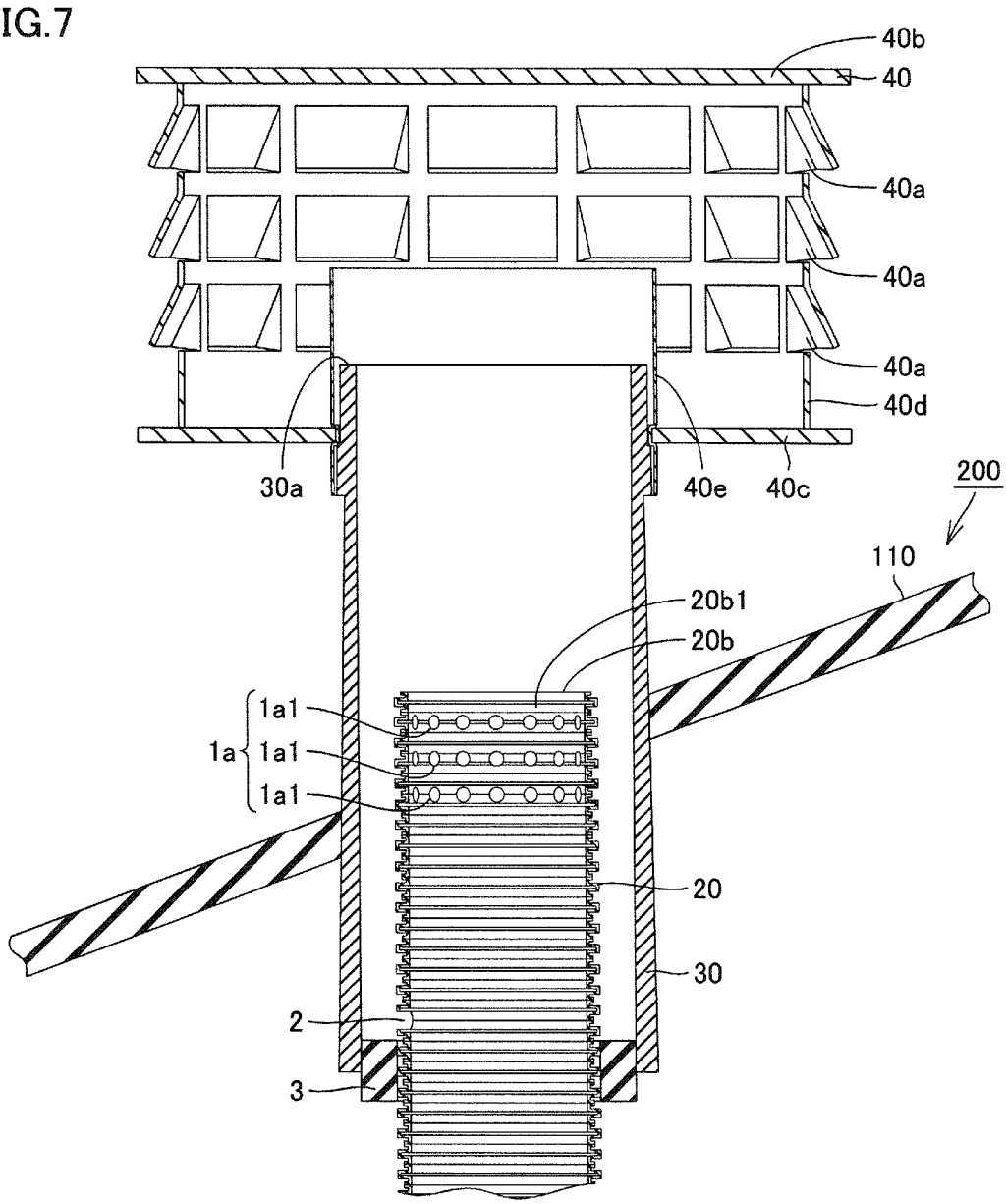
FIG. 7 is a cross-sectional view schematically showing the second step of the construction method of the exhaust structure for combustion apparatus in the first embodiment of the present invention.

Referring to FIG. 7, exhaust tube 20, which is provided with through hole portion 1*a* and drainage water recovering hole 2 described above and equipped with exhaust adapter 3, is inserted into exhaust pipe 30. In this insertion, exhaust adapter 3 is inserted into exhaust pipe 30 such that the outer circumferential surface of exhaust adapter 3 presses the inner circumferential surface of exhaust pipe 30.

Referring to FIG. 3, exhaust tube 20 is inserted into exhaust pipe 30 until the other end portion 20*b* of exhaust tube 20 comes into contact with ceiling wall 40*b* of exhaust terminal 40. Then, when one end portion 20*a* of exhaust tube 20 is connected to the combustion apparatus (connection pipe 56 of water heater 50: FIG. 4), construction of exhaust structure for combustion apparatus 100 in the present embodiment is completed.

Then, the functions and effects of the present embodiment will be described with reference to FIG. 3.

According to the present embodiment, as shown in FIG. 3, through hole portion 1*a* is provided as an exhaust passage hole on the side close to the other end portion 20*b* in exhaust tube 20 relative to exhaust adapter 3, and separately from opening 20*b*1 in the other end portion 20*b* of exhaust tube 20. Accordingly, even if the other end portion 20*b* of exhaust tube 20 is blocked by ceiling wall 40*b* of exhaust terminal 40, combustion gas can be emitted to the outside of the building via through hole portion 1*a* as an exhaust passage hole.

Furthermore, through hole portion 1*a* as an exhaust passage hole has an opening area greater than the cross-sectional area of the exhaust passage inside exhaust tube 20. Accordingly, exhaust resistance against the combustion gas is not caused by through hole portion 1*a*, so that combustion gas can be stably emitted to the outside of the building via through hole portion 1*a*.

Furthermore, since exhaust passage hole 1*a* is formed by through hole portion 1*a* provided in the outer circumferential surface of exhaust tube 20, combustion gas can be stably emitted to the outside of the building in such a simple configuration of providing through hole portion 1*a*. Furthermore, since through hole portion 1*a* includes a plurality of through holes 1*a*1 that are provided at a distance from each other in the outer circumferential surface of exhaust tube 20, the strength of exhaust tube 20 required for insertion into exhaust pipe 30 can be readily ensured. Furthermore, by providing through hole portion 1*a* consisting of a plurality of separate through holes 1*a*1, emission of combustion gas from exhaust tube 20 can be readily controlled.

Second Embodiment

Then, the configuration of the exhaust structure for combustion apparatus in the second embodiment will be hereinafter described with reference to FIGS. 8 to 11.

Figure 8:
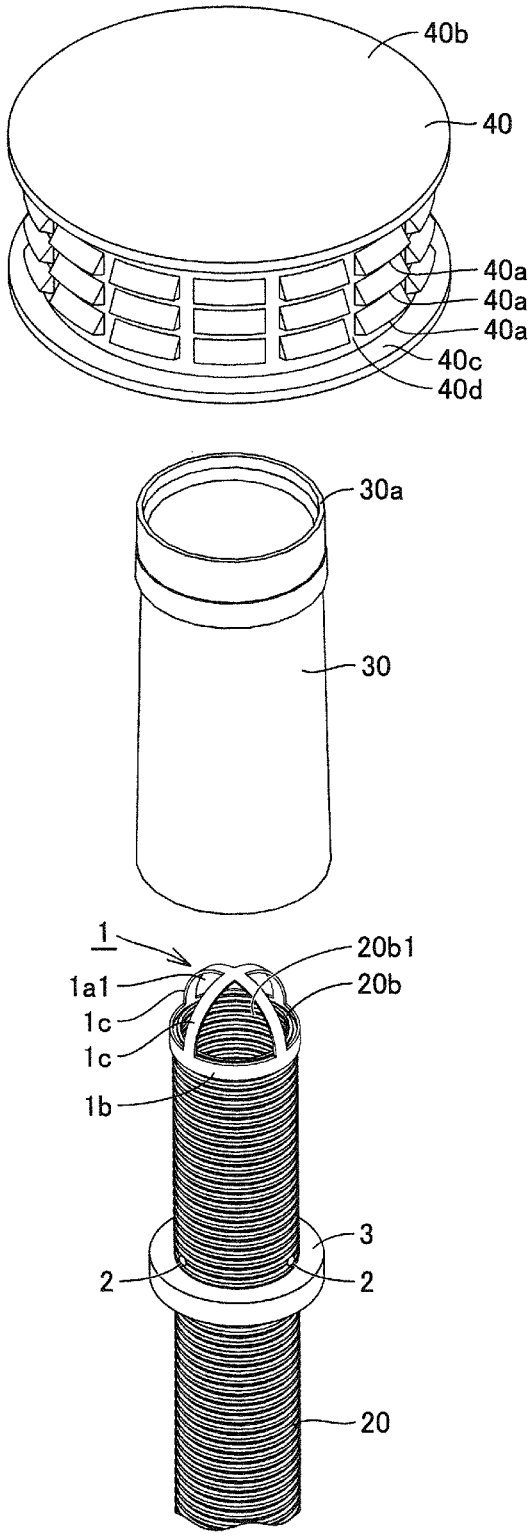
FIG. 8 is an exploded perspective view schematically showing the configuration of an exhaust structure for combustion apparatus in the second embodiment of the present invention.
Figure 9:
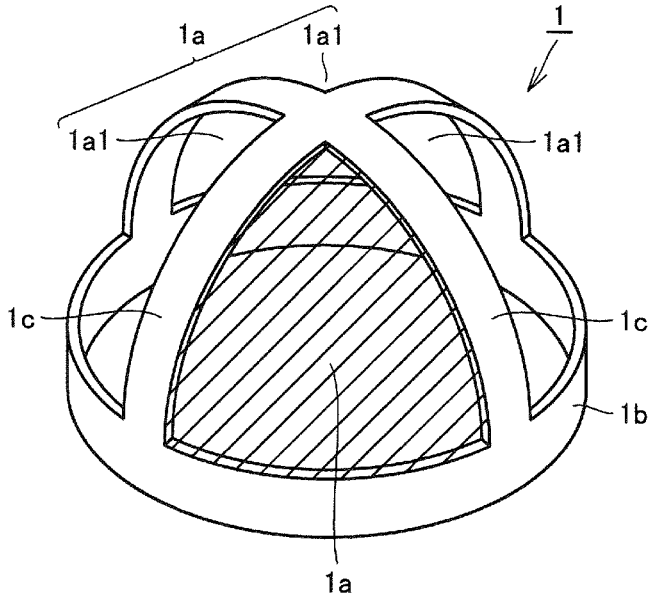
FIG. 9 is a perspective view schematically showing the configuration of a space formation member included in the exhaust structure for combustion apparatus in the second embodiment of the present invention.
Figure 10:
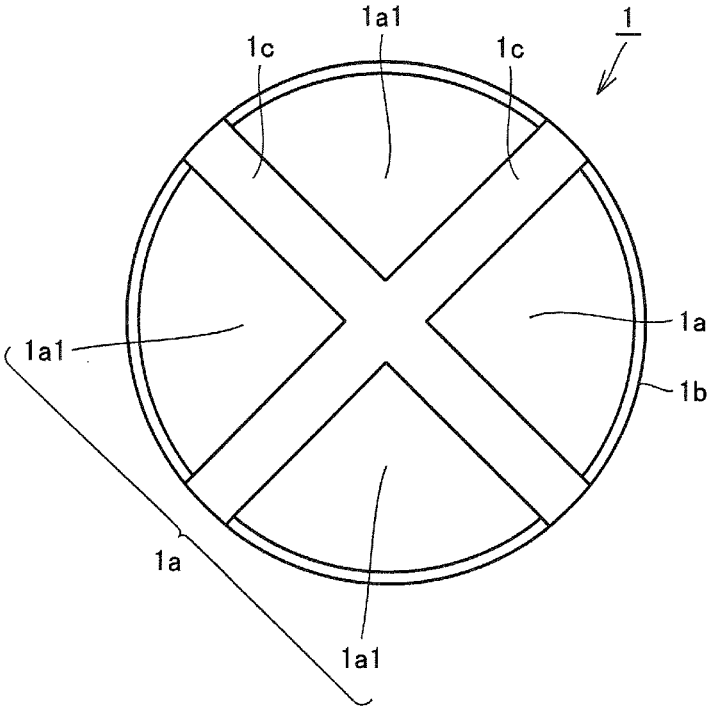
FIG. 10 is a plan view schematically showing the configuration of the space formation member included in the exhaust structure for combustion apparatus in the second embodiment of the present invention.

Referring to FIGS. 8 to 10, the configuration of exhaust structure for combustion apparatus 100 in the present embodiment is different from the configuration of the first embodiment in that exhaust tube 20 is not provided with a through hole portion, but instead, a space formation member 1 is attached to the other end portion 20*b* of exhaust tube 20. Space formation member 1 has an exhaust tube support portion 1*b* and a plate-shaped frame portion 1*c*. Exhaust tube support portion 1*b* is formed in an annular shape, and fitted on the outer circumferential surface of exhaust tube 20 and thereby supported by exhaust tube 20. Frame portion 1*c* extends above the region on the inner circumferential side in annular-shaped exhaust tube support portion 1*b* and is connected to one end portion and the other end portion of exhaust tube support portion 1*b* that are opposed to each other, thereby forming an arch shape.

In the present embodiment, two frame portions 1*c* are connected to exhaust tube support portion 1*b*. Two frame portions 1*c* are arranged so as to be orthogonal to each other in a plan view as shown in FIG. 10. The number of frame portions 1*c* is not limited to two, but may be one, or may be three or more.

Exhaust passage hole 1*a* is provided in space formation member 1 and provided with a plurality of openings 1*a*1. Each of the plurality of openings 1*a*1 is provided so as to be surrounded by frame portion 1*c* and exhaust tube support portion 1*b*. As shown in FIG. 9, the opening area of each opening 1*a*1 is equal to an area of a plane that is surrounded by frame portion 1*c* and exhaust tube support portion 1*b* and curved along a dome shape formed by frame portion 1*c* (a plane with hatching lines in FIG. 9). The opening area of exhaust passage hole 1*a* is equal to the total sum of the opening areas of the plurality of openings 1*a*1.

Figure 11:
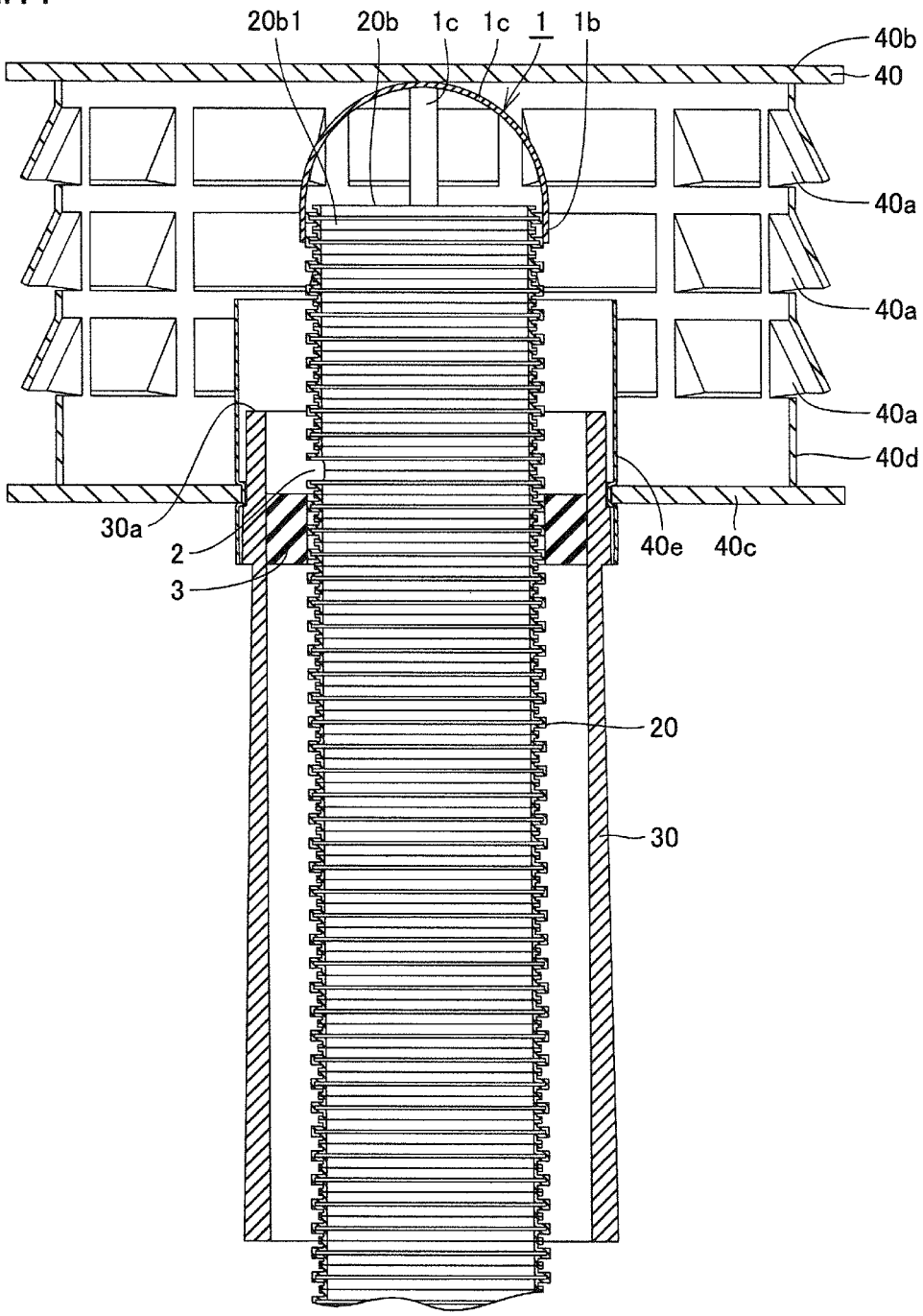
FIG. 11 is a cross-sectional view schematically showing the configuration of the exhaust structure for combustion apparatus in the second embodiment of the present invention.
Figure 12:
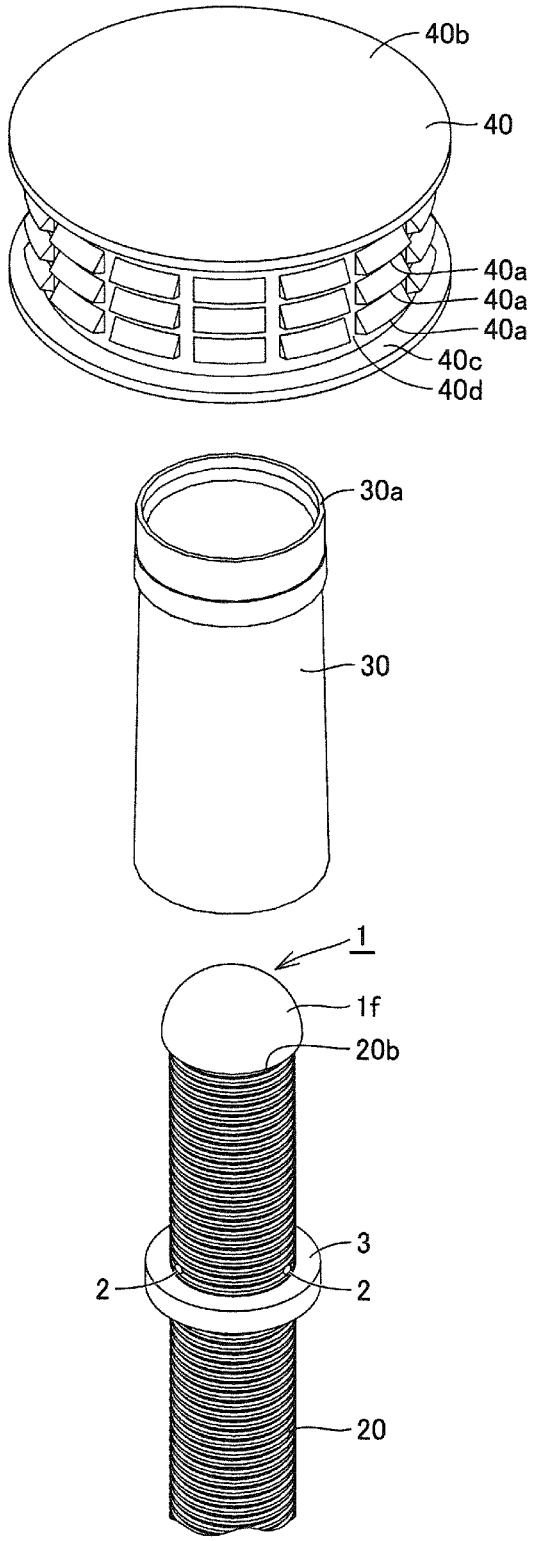
FIG. 12 is an exploded perspective view schematically showing the configuration of an exhaust structure for combustion apparatus in the third embodiment of the present invention.
Figure 13:
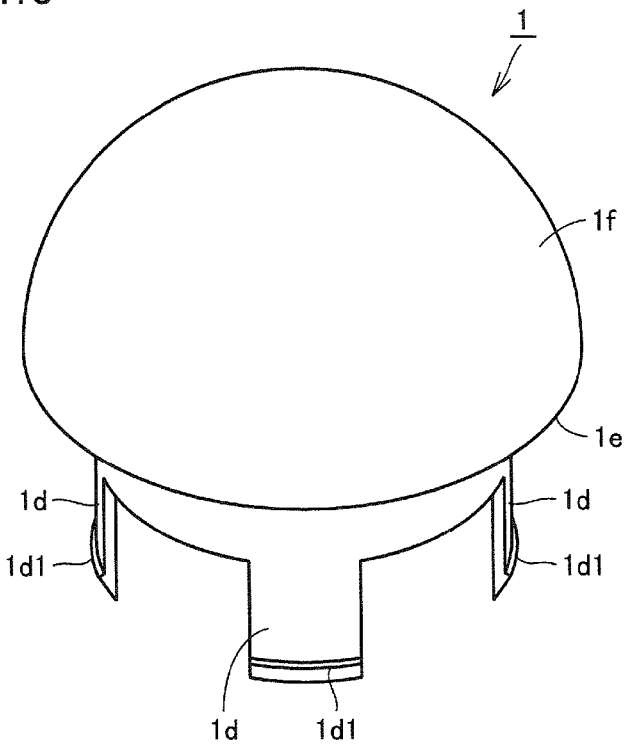
FIG. 13 is a perspective view schematically showing the configuration of the first example of a space formation member included in the exhaust structure for combustion apparatus in the third embodiment of the present invention.

Referring to FIG. 11, exhaust tube 20 to which space formation member 1 is attached is inserted into exhaust pipe 30 until the arch-shaped top portion of frame portion 1*c* comes into contact with ceiling wall 40*b* of exhaust terminal 40.

Since the configuration of exhaust structure for combustion apparatus 100 in the present embodiment other than those described above is almost the same as the configuration of the first embodiment, the same components are designated by the same reference characters, and the description thereof will not be repeated.

In the present embodiment, space formation member 1 is provided separately from exhaust tube 20 and exhaust passage hole 1*a* is provided in this space formation member 1, thereby improving the flexibility of each of the shape and the arrangement position of exhaust passage hole 1*a*. Therefore, it becomes possible to achieve a structure that is more suitable for emission of combustion gas.

Furthermore, since the space formation member includes a frame portion formed in the shape of an arch-shaped plate, the top portion of this arch can be brought into contact with ceiling wall 40*b* of exhaust terminal 40 as shown in FIG. 11 while combustion gas can be emitted through exhaust passage hole 1*a* between frame portion 1*c* and exhaust tube support portion 1*b*.

Also, according to the present embodiment, the total sum of the opening areas of openings 1*a*1 included in exhaust passage hole 1*a* is greater than the cross-sectional area of the exhaust passage inside exhaust tube 20 as in the first embodiment. Accordingly, exhaust resistance against combustion gas is not caused by exhaust passage hole 1*a* consisting of the plurality of openings 1*a*1, so that combustion gas can be stably emitted to the outside of the building through the plurality of openings 1*a*1.

Third Embodiment

Then, the configuration of the exhaust structure for combustion apparatus in the third embodiment will be hereinafter described with reference to FIGS. 12 to 20.

Referring to FIGS. 12 to 15, the configuration of exhaust structure for combustion apparatus 100 in the present embodiment is different from the configuration of the first embodiment in that exhaust tube 20 is not provided with a through hole portion, but instead, space formation member 1 is attached to the other end portion 20*b* of exhaust tube 20. Space formation member 1 has an exhaust tube support portion 1*d* attached to exhaust tube 20 and a protruding portion 1*e*, 1*f* protruding from exhaust tube support portion 1*d* to the side opposite to exhaust tube 20. Exhaust passage hole 1*a* is provided in protruding portion 1*e*, 1*f*.

Exhaust tube support portion 1*d* is provided at its end with an engaging portion 1*d*1 protruding to the outer circumferential side. By hooking this engaging portion 1*d*1 on the inner circumferential surface of exhaust tube 20, exhaust tube support portion 1*d* is supported by the inner circumferential surface of exhaust tube 20.

Protruding portion 1*e*, 1*f* has a flange portion 1*e* and a curved portion 1*f*. Flange portion 1*e* is connected to exhaust tube support portion 1*d* and extends radially outward. Curved portion 1*f* is connected to the outer circumferential edge of flange portion 1*e*, and has a convex shape curved toward the side opposite to exhaust tube support portion 1*d* relative to flange portion 1*e*.

Figure 14:
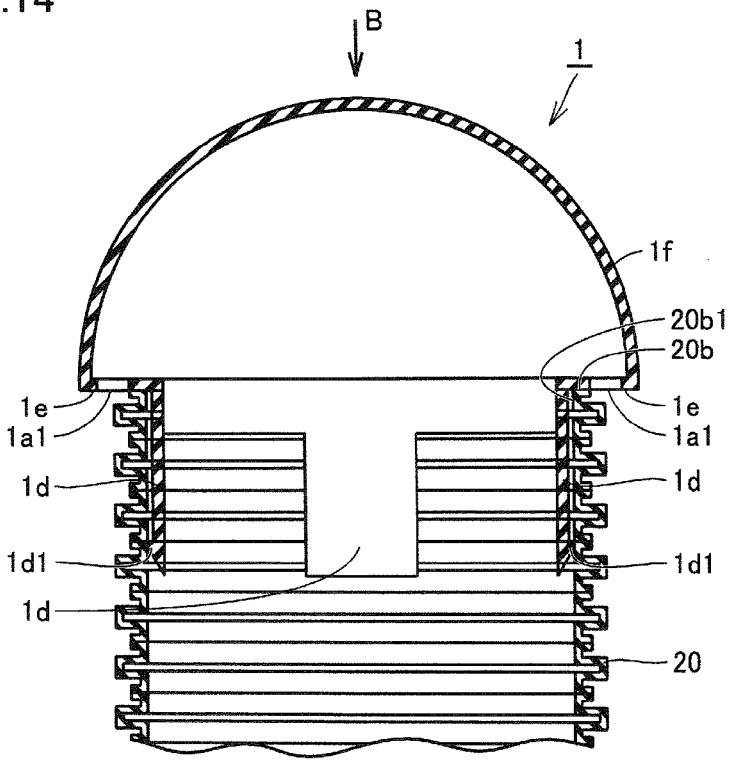
FIG. 14 is a cross-sectional view schematically showing the state where the first example of the space formation member included in the exhaust structure for combustion apparatus in the third embodiment of the present invention is attached to an exhaust tube.
Figure 15:
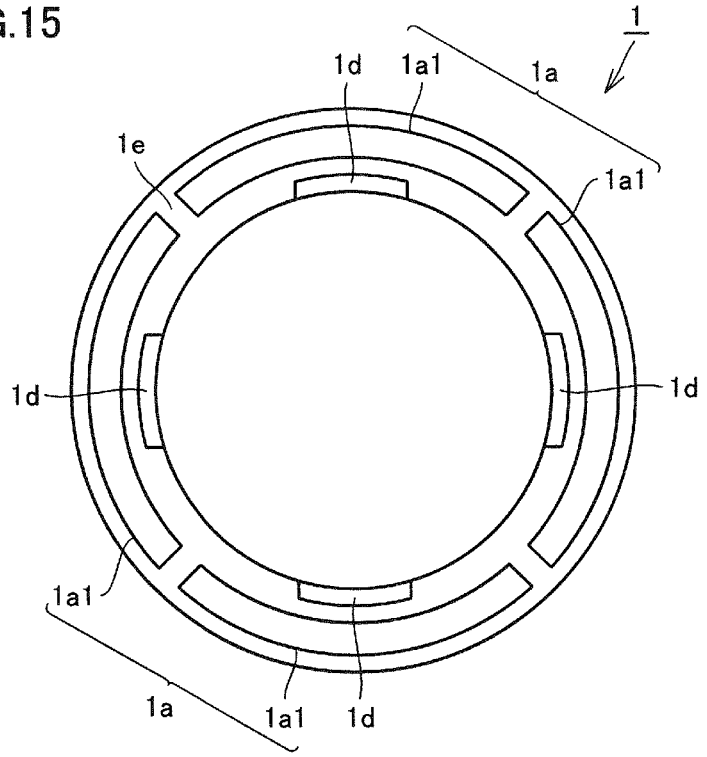
FIG. 15 is a bottom view schematically showing the configuration of the first example of the space formation member included in the exhaust structure for combustion apparatus in the third embodiment of the present invention.

As shown in FIGS. 14 and 15, exhaust passage hole 1*a* is provided in flange portion 1*e* and has a plurality of openings 1*a*1. A plurality of (for example, four) openings 1*a*1 are arranged along the circumference of flange portion 1*e* as shown in FIG. 15. The opening area of exhaust passage hole 1*a* is equal to the total sum of the opening areas of the plurality of openings 1*a*1. Since exhaust passage hole 1*a* consisting of the plurality of openings 1*a*1 is provided in flange portion 1*e*, exhaust passage hole 1*a* is located at a position where exhaust passage hole 1*a* cannot be seen when curved portion 1*f* is viewed from the curved portion 1*f* side toward the exhaust tube support portion 1*d* side as indicated by an arrow B in FIG. 14.

Figure 16:
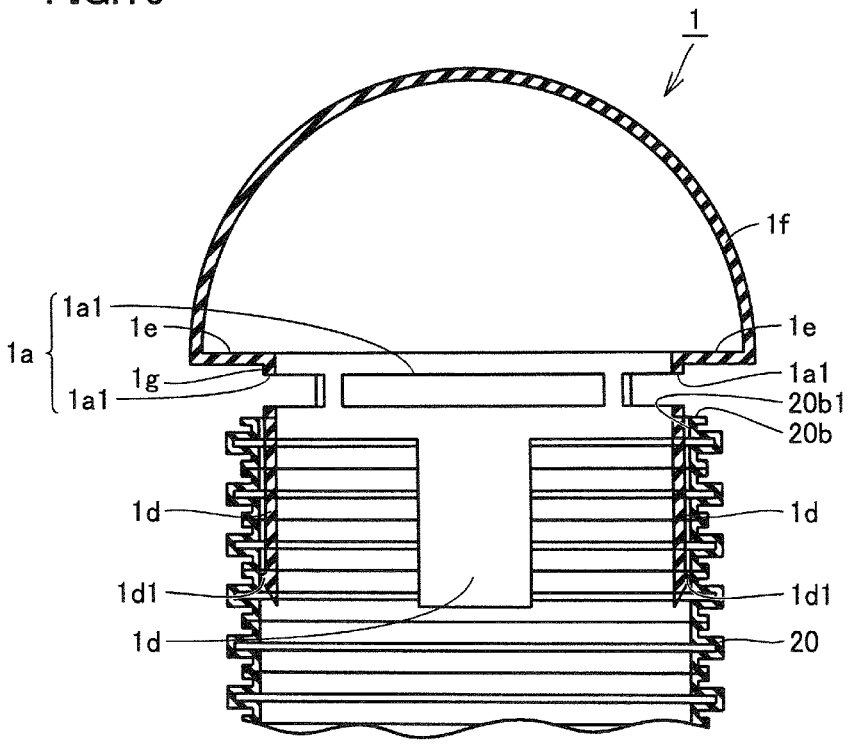
FIG. 16 is a cross-sectional view schematically showing the state where the second example of the space formation member included in the exhaust structure for combustion apparatus in the third embodiment of the present invention is attached to the exhaust tube.
Figure 17:
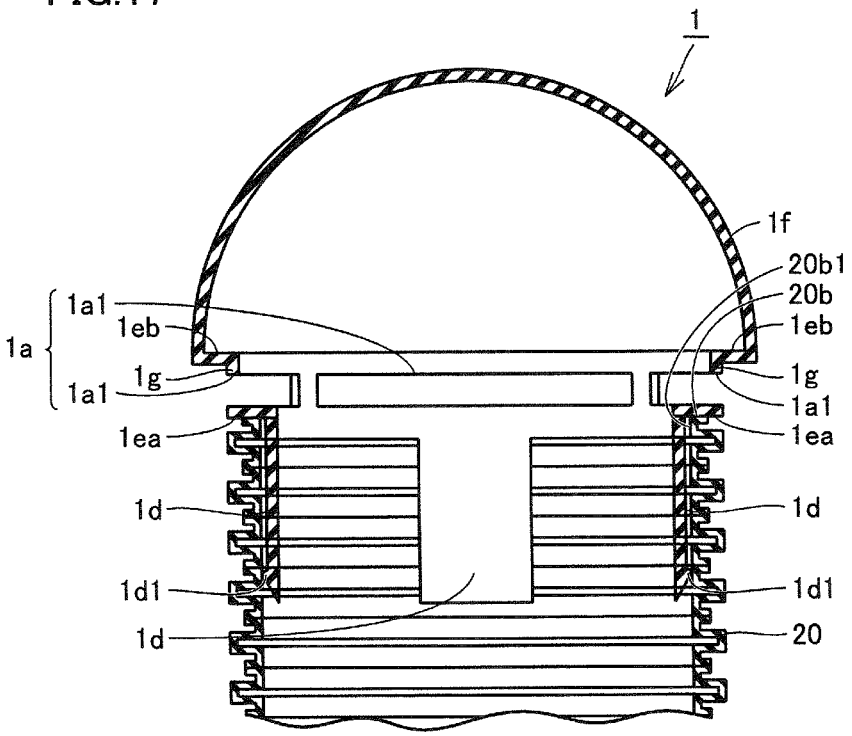
FIG. 17 is a cross-sectional view schematically showing the state where the third example of the space formation member included in the exhaust structure for combustion apparatus in the third embodiment of the present invention is attached to the exhaust tube.

Furthermore, as shown in FIG. 16 or 17, a reduced diameter portion 1*g* may be additionally provided between exhaust tube support portion 1*d* and flange portion 1*e*, and a plurality of openings 1*a*1 constituting exhaust passage hole 1*a* may be provided in reduced diameter portion 1*g*. Reduced diameter portion 1*g* shown in FIG. 16 is formed in an annular shape and has the same diameter as that of exhaust tube support portion 1*d*. Reduced diameter portion 1*g* shown in FIG. 17 is formed in an annular shape and has a diameter larger than that of exhaust tube support portion 1*d*. Accordingly, in space formation member 1 shown in FIG. 17, a first flange portion 1*ea* extending in the radial direction is provided between exhaust tube support portion 1*d* and reduced diameter portion 1*g* while a second flange portion 1*eb* extending in the radial direction is provided between reduced diameter portion 1*g* and curved portion 1*f*. In this configuration, the end face of the other end portion 20*b* of exhaust tube 20 is brought into contact with first flange portion 1*ea*, so that exhaust passage hole 1*a* consisting of the plurality of openings 1*a*1 can be prevented from being blocked by exhaust tube 20.

Figure 18:
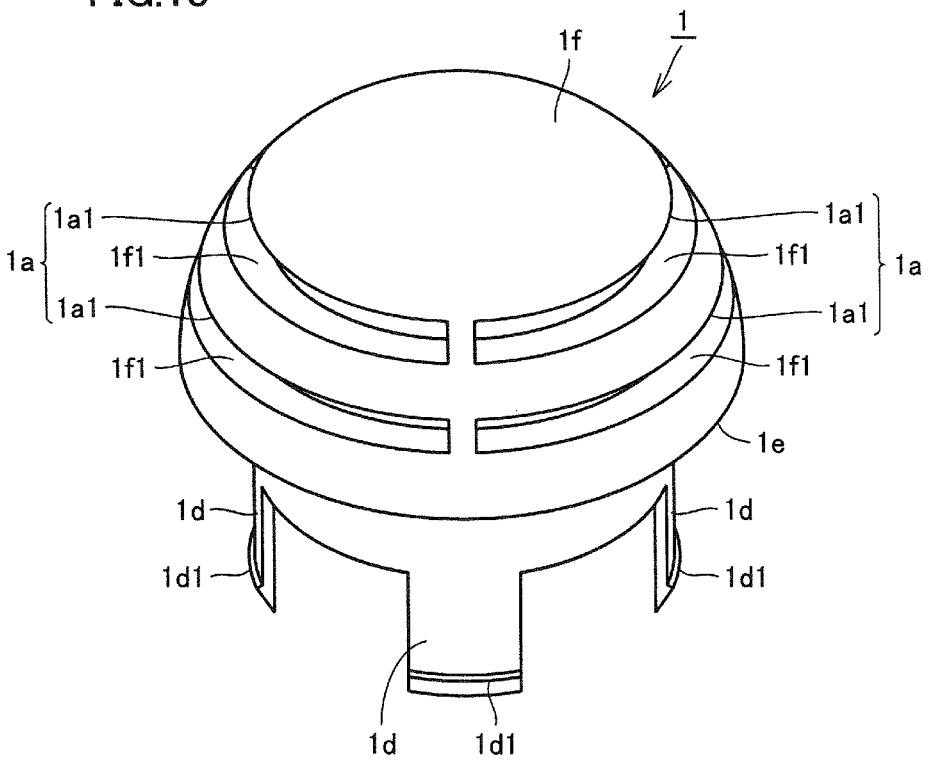
FIG. 18 is a perspective view schematically showing the configuration of the fourth example of the space formation member included in the exhaust structure for combustion apparatus in the third embodiment of the present invention.
Figure 19:
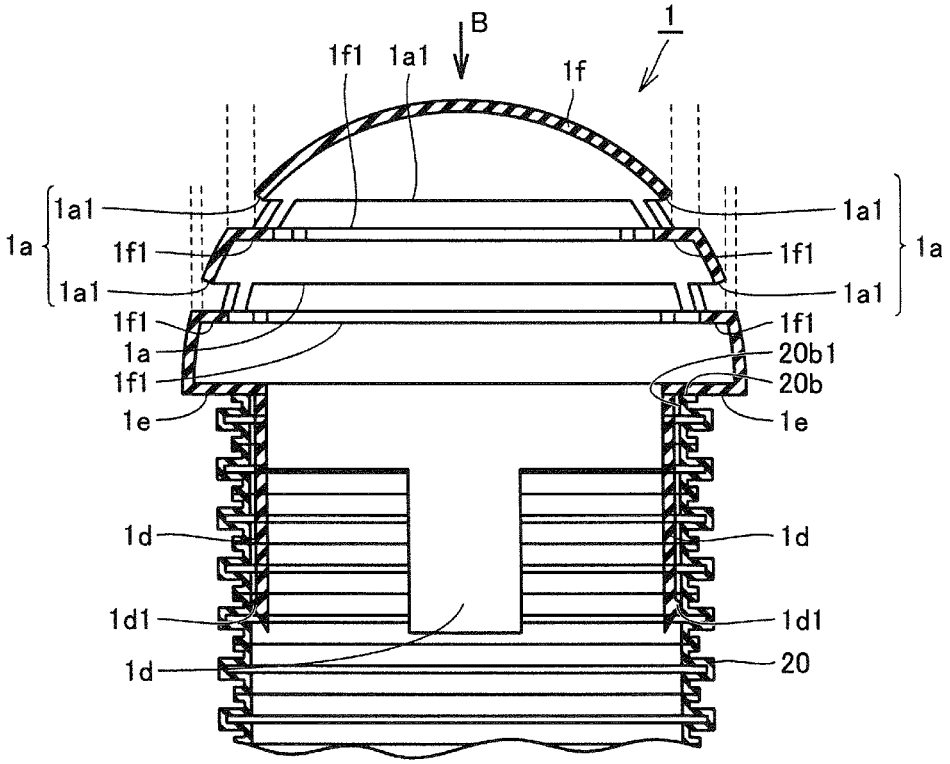
FIG. 19 is a cross-sectional view schematically showing the state where the fourth example of the space formation member included in the exhaust structure for combustion apparatus in the third embodiment of the present invention is attached to the exhaust tube.
Figure 20:
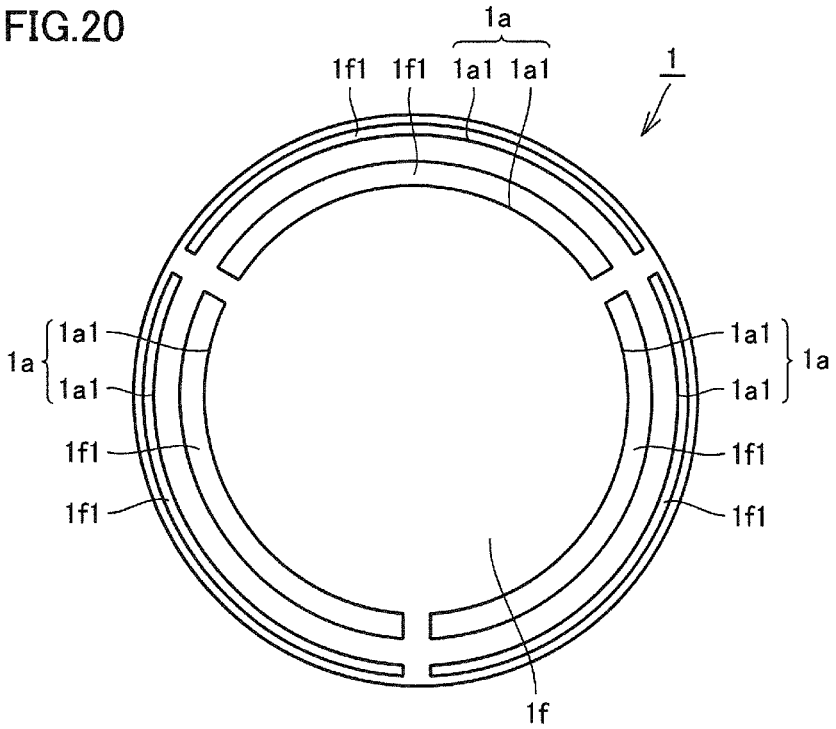
FIG. 20 is a plan view schematically showing the configuration of the fourth example of the space formation member included in the exhaust structure for combustion apparatus in the third embodiment of the present invention.

Also as shown in FIGS. 18 to 20, a plurality of openings 1*a*1 constituting exhaust passage hole 1*a* may be provided in curved portion 1*f*. Each of the plurality of openings 1*a*1 is provided by cutting a part of the surface portion of curved portion 1*f* and bending this part. Accordingly, a bent portion 1*f*1 is located below opening 1*a*1 (on the exhaust tube support portion 1*d* side) and bent inside the dome shape of curved portion 1*f* (on the inner circumferential side).

By forming bent portion 1*f*1 in this way, only bent portion 1*f*1 can be seen but the exhaust passage of exhaust tube 20 cannot be seen through opening 1*a*1 when curved portion 1*f* is viewed from the curved portion 1*f* side toward the exhaust tube support portion 1*d* side as indicated by an arrow B shown in FIG. 19.

Since the configuration of exhaust structure for combustion apparatus 100 in the present embodiment other than those described above is almost the same as the configuration of the first embodiment, the same components are designated by the same reference characters, and the description thereof will not be repeated.

In the present embodiment, space formation member 1 has protruding portion 1*e*, 1*f* (alternatively, protruding portion 1*e*, 1*f*, 1*g*) provided with exhaust passage hole 1*a*. Accordingly, the top portion of protruding portion 1*e*, 1*f* (alternatively, protruding portion 1*e*, 1*f*, 1*g*) (the top portion of curved portion 1*f*) can be brought into contact with ceiling wall 40*b* of exhaust terminal 40 while combustion gas can be emitted through exhaust passage hole 1*a*.

Furthermore, curved portion 1*f* of space formation member 1 is curved in a convex shape. Accordingly, when the other end portion 20*b* of exhaust tube 20 having this space formation member 1 attached thereto is inserted into exhaust pipe 30, the contact resistance between curved portion 1*f* and the inner circumferential surface of exhaust pipe 30 can be reduced. Furthermore, even if exhaust pipe 30 is curved, exhaust tube 20 can be smoothly moved through exhaust pipe 30. Consequently, exhaust tube 20 having space formation member 1 attached thereto can be smoothly inserted into exhaust pipe 30 and moved therethrough.

Furthermore, in the configuration shown in FIGS. 12 to 15, the configuration shown in FIG. 16, and the configuration shown in FIG. 17, a plurality of openings 1*a*1 constituting exhaust passage hole 1*a* each are provided at a position where the plurality of openings 1*a*1 cannot be seen when curved portion 1*f* is viewed from the curved portion 1*f* side toward the exhaust tube support portion 1*d* side. Accordingly, when the other end portion 20*b* of exhaust tube 20 having this space formation member 1 attached thereto is inserted into exhaust pipe 30, foreign substances are less likely to come into exhaust tube 20 through each opening 1*a*1 of space formation member 1.

Furthermore, in the configuration shown in FIGS. 18 to 20, only bent portion 1*f*1 can be seen but the exhaust passage of exhaust tube 20 cannot be seen through the plurality of openings 1*a*1 constituting exhaust passage hole 1*a* when curved portion 1*f* is viewed from the curved portion 1*f* side toward the exhaust tube support portion 1*d* side. Accordingly, when the other end portion 20*b* of exhaust tube 20 having this space formation member 1 attached thereto is inserted into exhaust pipe 30, foreign substances are less likely to come into exhaust tube 20 through each opening 1*a*1 of space formation member 1 because bent portion 1*f*1 becomes an obstacle.

Fourth Embodiment

Then, the configuration of the exhaust structure for combustion apparatus in the fourth embodiment will be hereinafter described with reference to FIGS. 21 to 25.

Figure 21:
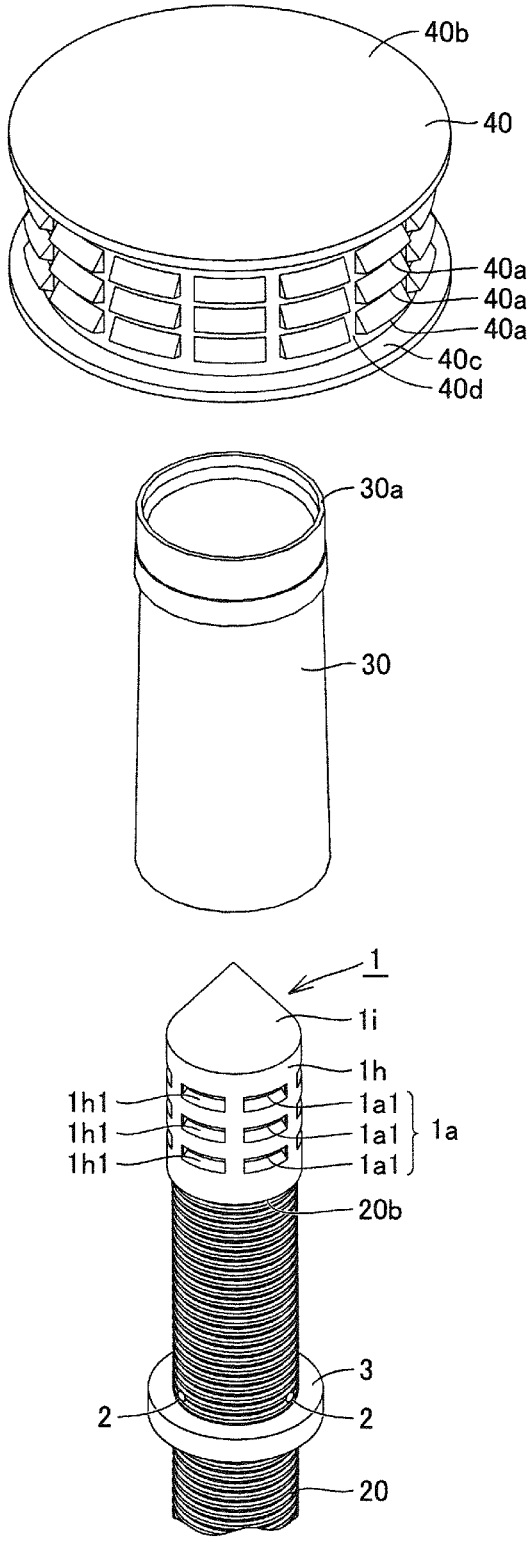
FIG. 21 is an exploded perspective view schematically showing the configuration of an exhaust structure for combustion apparatus in the fourth embodiment of the present invention.
Figure 22:
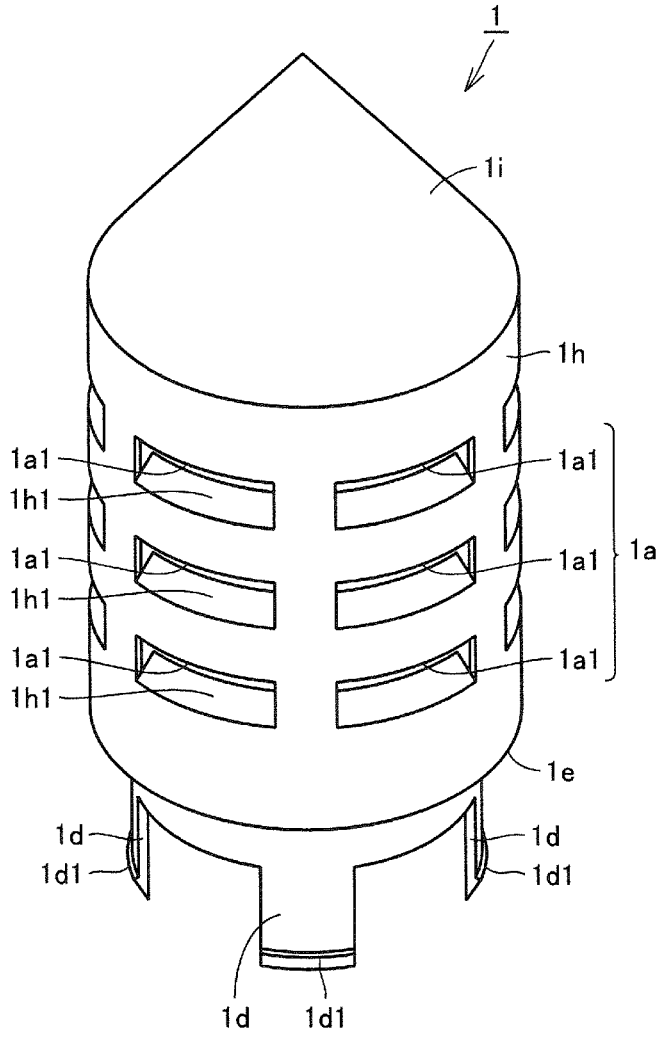
FIG. 22 is a perspective view schematically showing the configuration of the first example of a space formation member included in the exhaust structure for combustion apparatus in the fourth embodiment of the present invention.
Figure 23:
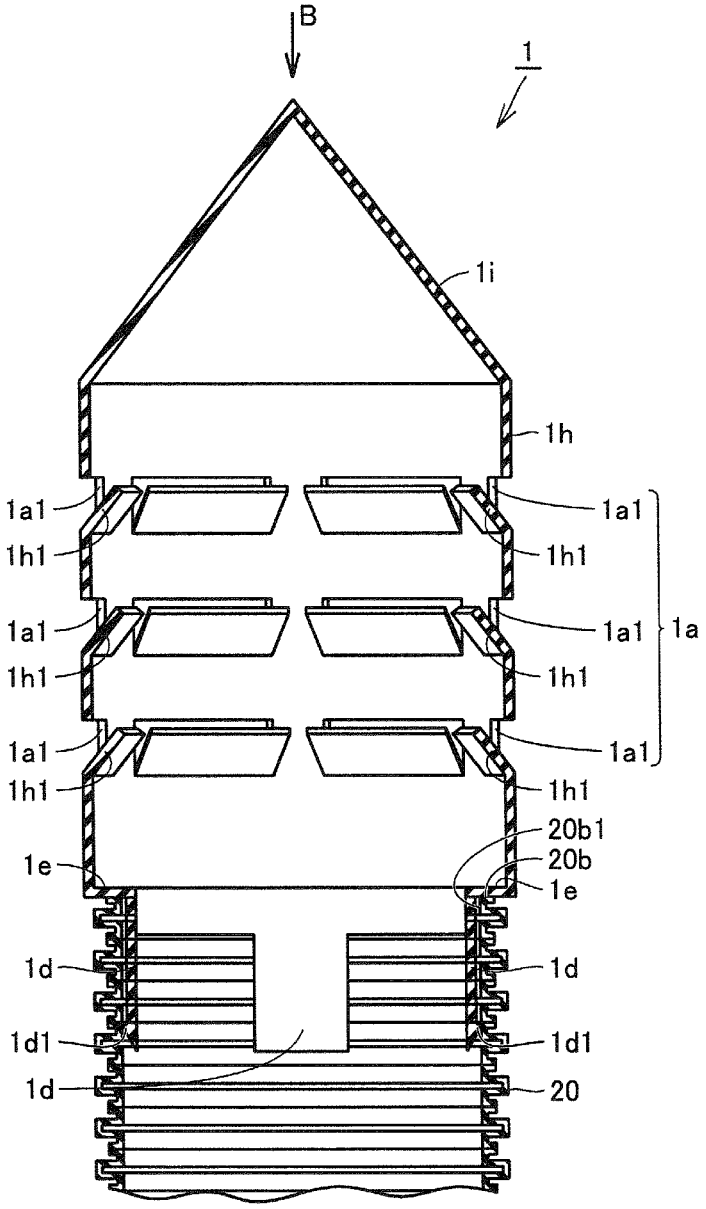
FIG. 23 is a cross-sectional view schematically showing the state where the first example of the space formation member included in the exhaust structure for combustion apparatus in the fourth embodiment of the present invention is attached to the exhaust tube.

Referring to FIGS. 21 to 23, the configuration of exhaust structure for combustion apparatus 100 in the present embodiment is different from the configuration of the first embodiment in that a through hole portion is not provided in exhaust tube 20, but instead, space formation member 1 is attached to the other end portion 20*b* of exhaust tube 20. Space formation member 1 includes an exhaust tube support portion 1*d* attached to exhaust tube 20 and protruding portion 1*e*, 1*h*, 1*i* protruding from exhaust tube support portion 1*d* to the side opposite to exhaust tube 20.

Protruding portion 1*e*, 1*h*, 1*i* has a flange portion 1*e*, a cylindrical portion 1*h*, and a tip end portion 1*i*. Flange portion 1*e* extends radially outward from exhaust tube support portion 1*d*. Cylindrical portion 1*h* is connected to the outer circumferential edge of flange portion 1*e*. Tip end portion 1*i* is connected to the end of cylindrical portion 1*h* and formed in a conical shape, for example. Exhaust passage hole 1*a* is provided in cylindrical portion 1*h* and includes a plurality of openings 1*a*1. As shown in FIG. 15, the plurality of openings 1*a*1 are arranged along the circumference of cylindrical portion 1*h* and also arranged along the direction in which cylindrical portion 1*h* extends (in the axial direction). The opening area of exhaust passage hole 1*a* is equal to the total sum of the opening areas of the plurality of openings 1*a*1.

Each of the plurality of openings 1*a*1 is formed by cutting a part of the surface portion of cylindrical portion 1*h* and bending this part. Bent portion 1*h*1 obtained by this bending is located, for example, below opening 1*a*1 (on the exhaust tube support portion 1*d* side) and bent inward (on the inner circumferential side) relative to the outer circumferential surface having a cylindrical shape formed by cylindrical portion 1*h*.

By forming bent portion 1*h*1 in this way, each of the plurality of openings 1*a*1 cannot be seen when cylindrical portion 1*h* is viewed from the cylindrical portion 1*h* side toward the exhaust tube support portion 1*d* side as shown by an arrow B shown in FIG. 23.

Figure 24:
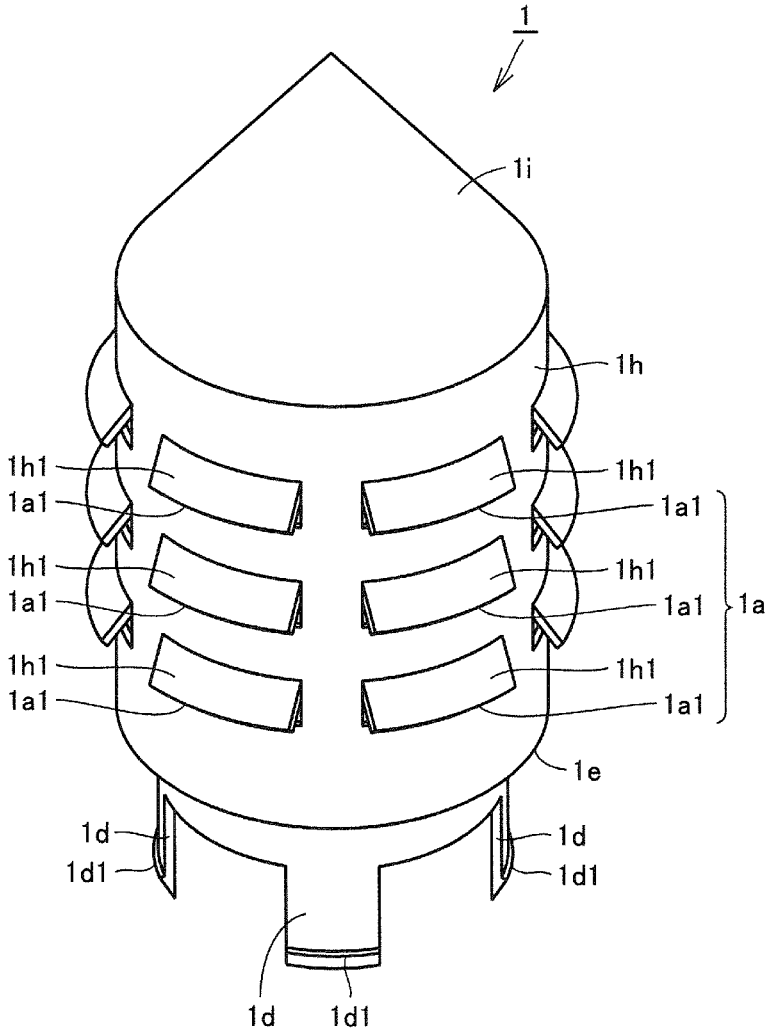
FIG. 24 is a perspective view schematically showing the configuration of the second example of the space formation member included in the exhaust structure for combustion apparatus in the fourth embodiment of the present invention.
Figure 25:
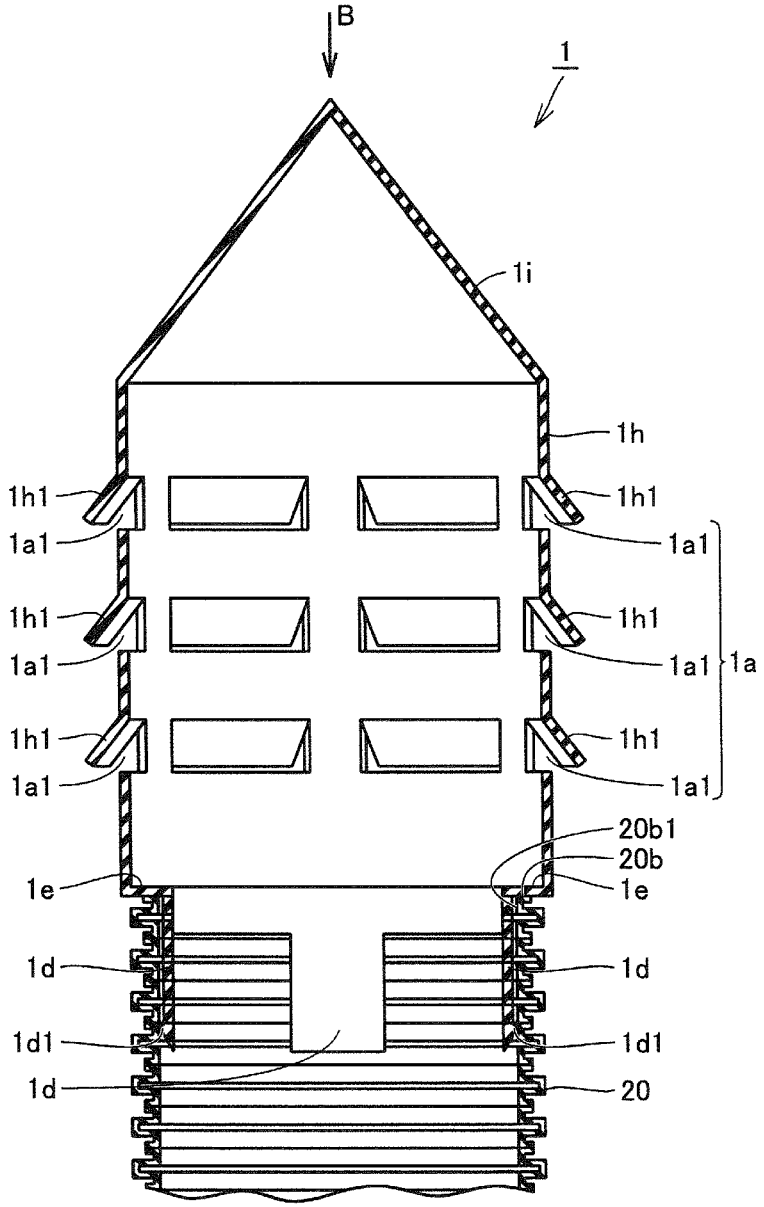
FIG. 25 is a cross-sectional view schematically showing the state where the second example of the space formation member included in the exhaust structure for combustion apparatus in the fourth embodiment of the present invention is attached to the exhaust tube.

Furthermore, as shown in FIGS. 24 and 25, bent portion 1*h*1 may be located above opening 1*a*1 (on the tip end portion 1*i* side) and may be bent outward (on the outer circumferential side) relative to the outer circumferential surface having a cylindrical shape formed by cylindrical portion 1*h*. Also in this configuration, due to bent portion 1*h*1 formed in this way, the plurality of openings 1*a*1 cannot be seen when cylindrical portion 1*h* is viewed from the cylindrical portion 1*h* side toward the exhaust tube support portion 1*d* side as indicated by arrow B shown in FIG. 25.

Although an explanation has been given in the above with regard to the configuration in which exhaust passage hole 1*a* is provided in cylindrical portion 1*h*, exhaust passage hole 1*a* only has to be provided at least one of cylindrical portions 1*h* and tip end portion 1*i*.

Since the configuration of exhaust structure for combustion apparatus 100 in the present embodiment other than those described above is almost the same as the configuration of the first embodiment, the same components are designated by the same reference characters, and the description thereof will not be repeated.

Although an explanation has been given in the above-described embodiment with regard to the case where tip end portion 1*i* has a conical shape, the shape of tip end portion 1*i* is not limited to a conical shape but may be a hemispherical shape or an elliptical hemispherical shape.

In the present embodiment, exhaust passage hole 1*a* is provided in at least one of cylindrical portions 1*h* and tip end portion 1*i* of space formation member 1. Accordingly, the top portion of tip end portion 1*i* can be brought into contact with ceiling wall 40*b* of exhaust terminal 40 while combustion gas can be emitted through exhaust passage hole 1*a*.

Furthermore, each of openings 1*a*1 is provided at a position where each opening 1*a*1 cannot be seen when cylindrical portion 1*h* is viewed from the cylindrical portion 1*h* side toward the exhaust tube support portion 1*d* side as indicated by arrow B shown in each of FIGS. 23 and 25. Accordingly, when the other end portion 20*b* of exhaust tube 20 having this space formation member 1 attached thereto is inserted into exhaust pipe 30, foreign substances are less likely to come into exhaust tube 20 through each of the plurality of openings 1*a*1 of space formation member 1.

Furthermore, space formation member 1 has cylindrical portion 1*h* and tip end portion 1*i*. Accordingly, when the other end portion 20*b* of exhaust tube 20 having this space formation member 1 attached thereto is inserted into exhaust pipe 30, exhaust tube 20 can be inserted into exhaust pipe 30 in a highly straight manner.

Fifth Embodiment

Then, the configuration of an exhaust structure for combustion apparatus in the fifth embodiment will be hereinafter described with reference to FIGS. 26 and 27.

Figure 26:
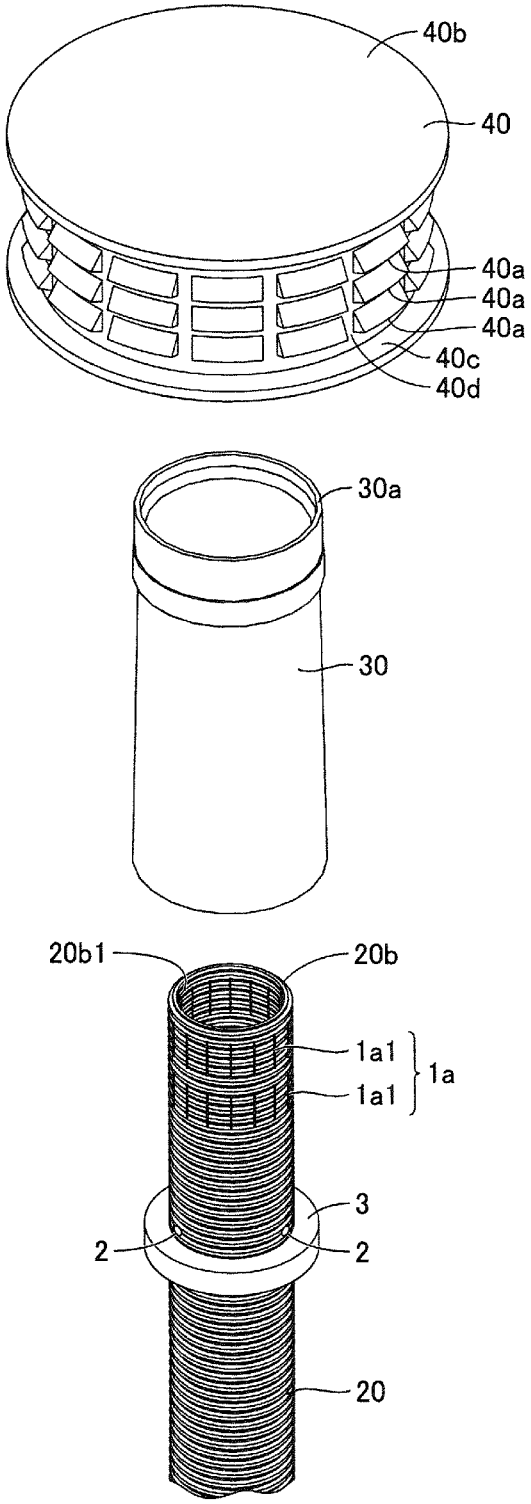
FIG. 26 is an exploded perspective view schematically showing the configuration of an exhaust structure for combustion apparatus in the fifth embodiment of the present invention.
Figure 27:
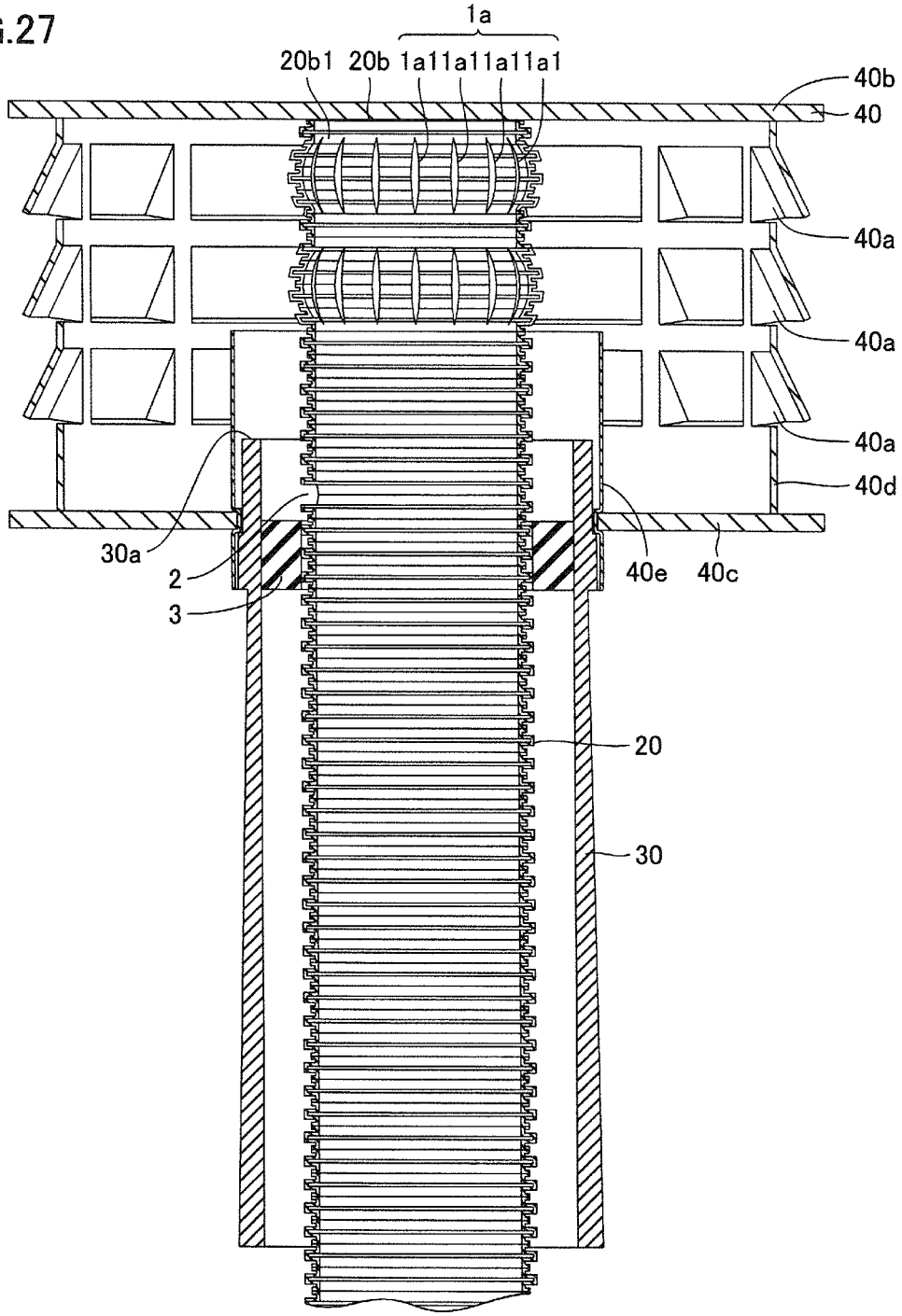
FIG. 27 is a cross-sectional view schematically showing the configuration of the exhaust structure for combustion apparatus in the fifth embodiment of the present invention.

Referring to FIGS. 26 and 27, the configuration of an exhaust structure for combustion apparatus 100 in the present embodiment is different from the configuration of the first embodiment in that exhaust tube 20 is provided with a plurality of cut portions 1*a*1 as an exhaust passage hole 1*a* in place of a through hole portion. Each of the plurality of cut portions 1*a*1 is obtained by cutting exhaust tube 20 from its outer circumferential surface to its inner circumferential surface. Each cut portion 1*a* is provided as a hole that is closed before the other end portion 20*b* of exhaust tube 20 comes into contact with ceiling wall 40*b* of exhaust terminal 40 but opened when the other end portion 20*b* of exhaust tube 20 comes into contact with ceiling wall 40*b* and compression force is exerted on exhaust tube 20, as shown in FIG. 27.

Exhaust passage hole 1*a* in the present embodiment consists of a plurality of cut portions 1*a*1 that are opened when exhaust tube 20 receives compression force. In the state where each cut portion 1*a*1 is opened in this way, the total sum of the opening areas of the plurality of cut portions 1*a*1 that are opened is greater than the cross-sectional area of the exhaust passage of exhaust tube 20.

Since the configuration of exhaust structure for combustion apparatus 100 in the present embodiment other than those described above is almost the same as the configuration of the first embodiment, the same components are designated by the same reference characters, and the description thereof will not be repeated.

In the present embodiment, each cut portion 1*a*1 is closed before the other end portion 20*b* of exhaust tube 20 comes into contact with ceiling wall 40*b* of exhaust terminal 40, as shown in FIG. 26. In this way, since each cut portion 1*a*1 is closed when inserting exhaust tube 20 into exhaust pipe 30, foreign substances can be prevented from coming into exhaust tube 20 through this each cut portion 1*a*1. Furthermore, when exhaust tube 20 comes into contact with ceiling wall 40*b* and compression force is exerted on exhaust tube 20, each cut portion 1*a*1 is opened, as shown in FIG. 27. After insertion of exhaust tube 20 into exhaust pipe 30 is completed in this way, each cut portion 1*a*1 is opened by compression force. Accordingly, even if the other end portion 20*b* of exhaust tube 20 is blocked by ceiling wall 40*b*, combustion gas can be emitted from inside exhaust tube 20.

Others

Figure 28:
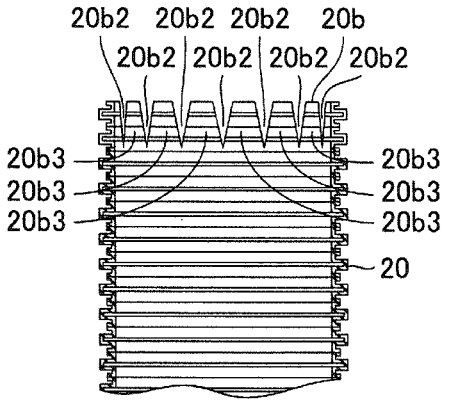
FIG. 28 is a cross-sectional view schematically showing the state where a cut portion used for a tube-diameter reducing process is formed in the other end portion of the exhaust tube.
Figure 29:
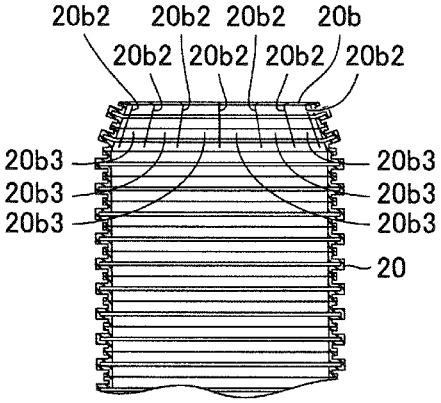
FIG. 29 is a cross-sectional view schematically showing the state where the other end portion of the exhaust tube is subjected to the tube-diameter reducing process.

In the above-described first to fifth embodiments, the other end portion 20*b* of exhaust tube 20 may be subjected to a tube-diameter reducing process so as to reduce the diameter of the other end portion 20*b* of exhaust tube 20 toward its end. This tube-diameter reducing process is carried out as in the following manner: for example, as shown in FIG. 28, a plurality of V-shaped cut portions 20*b*2 are formed in the other end portion 20*b* of exhaust tube 20, and then, the ends of a plurality of tip end portions 20*b*3 separated by these V-shaped cut portions 20*b*2 are inclined toward the inner circumferential side as shown in FIG. 29, so that tip end portions 20*b*3 adjacent to each other are connected to each other. By this tube-diameter reducing process, the other end portion 20*b* of exhaust tube 20 is reduced in diameter toward its end as shown in FIG. 29, so that the other end portion 20*b* can be readily inserted into exhaust pipe 30.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An exhaust structure for a combustion apparatus, comprising:

an exhaust tube including one end portion and the other end portion and connected at said one end portion to said combustion apparatus, of which inside is defined as an exhaust passage for combustion gas;

an exhaust pipe having an outer diameter greater than that of said exhaust tube, the exhaust tube penetrating the exhaust pipe, and the other end portion of the exhaust tube protruding from the exhaust pipe; and an exhaust adapter attached between an outer circumferential surface of said exhaust tube and an inner circumferential surface of said exhaust pipe, an exhaust passage hole being provided on a side closer to said other end portion in said exhaust tube relative to said exhaust adapter, the exhaust passage hole being provided separately from an opening in said other end portion of said exhaust tube, and having an opening area greater than a cross-sectional area of said exhaust passage, and being in communication with said exhaust passage.

2. The exhaust structure for the combustion apparatus according to claim 1, wherein said exhaust passage hole is a through hole portion provided in said exhaust tube.

3. The exhaust structure for the combustion apparatus according to claim 2, wherein said through hole portion includes a plurality of through holes provided in said exhaust tube so as to be spaced apart from each other.

4. The exhaust structure for the combustion apparatus according to claim 1, wherein said exhaust passage hole is a hole of a cut portion in said exhaust tube, the cut portion being formed from said outer circumferential surface to an inner circumferential surface, and the cut portion is configured to open to form the hole when said exhaust tube is compressed.

5. An exhaust structure for a combustion apparatus, comprising:

an exhaust tube including one end portion and the other end portion and connected at said one end portion to said combustion apparatus, of which inside is defined as an exhaust passage for combustion gas;

an exhaust pipe having an outer diameter greater than that of said exhaust tube, into which a part of said exhaust tube on a side of said other end portion is introduced; and an exhaust adapter attached between an outer circumferential surface of said exhaust tube and an inner circumferential surface of said exhaust pipe, an exhaust passage hole being provided on a side closer to said other end portion in said exhaust tube relative to said exhaust adapter, the exhaust passage hole being provided separately from an opening in said other end portion of said exhaust tube, and having an opening area greater than a cross-sectional area of said exhaust passage, and being in communication with said exhaust passage, the exhaust structure further comprising a member attached to said other end portion of said exhaust tube, wherein said exhaust passage hole is provided in said member.

6. The exhaust structure for the combustion apparatus according to claim 5, wherein said member includes an exhaust tube support portion supported by said exhaust tube, and a frame portion formed in a shape of an arch-shaped plate and supported by said exhaust tube support portion, and said exhaust passage hole is surrounded by said frame portion and said exhaust tube support portion.

7. The exhaust structure for the combustion apparatus according to claim 5, wherein said member has an exhaust tube support portion supported by said exhaust tube, and a protruding portion protruding from said exhaust tube support portion to a side opposite to said exhaust tube, and said exhaust passage hole is provided in said protruding portion.

8. The exhaust structure for the combustion apparatus according to claim 7, wherein said protruding portion includes a reduced diameter portion, a flange portion extending radially outward from said reduced diameter portion, and a curved portion curved in a convex shape toward a side opposite to said reduced diameter portion relative to said flange portion, and said exhaust passage hole is provided in one or more selected from a group consisting of said reduced diameter portion, said flange portion and said curved portion.

9. The exhaust structure for the combustion apparatus according to claim 7, wherein said exhaust passage hole is provided at a position where said exhaust passage hole cannot be seen when said protruding portion is viewed from a side of said protruding portion toward a side of said exhaust tube support portion.

10. The exhaust structure for the combustion apparatus according to claim 7, wherein said protruding portion includes a cylindrical portion extending from said exhaust tube support portion and a tip end portion formed at a tip end of said cylindrical portion, and said exhaust passage hole is provided in at least one of said cylindrical portion and said tip end portion.

11. A method of constructing an exhaust structure for a combustion apparatus, by which an exhaust tube is inserted into an exhaust pipe extending from inside to outside of a building, an exhaust terminal being provided at a tip end portion of said exhaust pipe on the outside, said method comprising the steps of:

providing an exhaust passage hole in said exhaust tube having one end portion and the other end portion so as to be located on a side of said other end portion separately from an opening in said other end portion of said exhaust tube, said exhaust passage hole having an opening area greater than a cross-sectional area of an exhaust passage and being in communication with an inner passage of said exhaust tube;

inserting said exhaust tube into said exhaust pipe until a part of said exhaust tube on the side of said other end portion provided with said exhaust passage hole comes into contact with a ceiling wall of said exhaust terminal; and connecting said one end portion of said exhaust tube to said combustion apparatus.

* * * * *